US007368212B2

(12) United States Patent
Sugiura et al.

(10) Patent No.: US 7,368,212 B2
(45) Date of Patent: May 6, 2008

(54) TONER FOR DEVELOPING ELECTROSTATIC IMAGE, DEVELOPER, IMAGE FORMING APPARATUS, PROCESS FOR FORMING IMAGE, PROCESS CARTRIDGE AND PROCESS FOR MEASURING POROSITY OF TONER

(75) Inventors: Hideki Sugiura, Shizuoka (JP); Satoshi Mochizuki, Shizuoka (JP); Yasuaki Iwamoto, Shizuoka (JP); Yasuo Asahina, Shizuoka (JP); Akihiro Kotsugai, Shizuoka (JP); Shinya Nakayama, Shizuoka (JP); Tomoyuki Ichikawa, Shizuoka (JP); Koichi Sakata, Shizuoka (JP); Tomoko Utsumi, Shizuoka (JP); Hisashi Nakajima, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 213 days.

(21) Appl. No.: 10/875,402

(22) Filed: Jun. 25, 2004

(65) Prior Publication Data

US 2005/0026064 A1 Feb. 3, 2005

(30) Foreign Application Priority Data

Jun. 25, 2003 (JP) ..... 2003-180732

(51) Int. Cl.
*G03G 9/08* (2006.01)

(52) U.S. Cl. ..... 430/109.4; 430/110.1; 430/110.3; 430/137.1

(58) Field of Classification Search ..... 430/109.4, 430/110.1, 137.1, 110.3
See application file for complete search history.

(56) References Cited

U.S. PATENT DOCUMENTS

| | | | | |
|---|---|---|---|---|
| 4,074,001 | A | | 2/1978 | Imai et al. |
| 4,172,976 | A | | 10/1979 | Namiki et al. |
| 4,254,201 | A | * | 3/1981 | Sawai et al. ..... 430/110.2 |
| 4,284,875 | A | | 8/1981 | Namiki et al. |
| 4,379,825 | A | * | 4/1983 | Mitushashi ..... 430/110.4 |
| 4,762,763 | A | | 8/1988 | Nomura et al. |
| 4,841,331 | A | | 6/1989 | Nakayama et al. |
| 4,933,250 | A | | 6/1990 | Nakayama et al. |
| 4,945,022 | A | | 7/1990 | Nakayama et al. |
| 4,980,258 | A | | 12/1990 | Aoki et al. |
| 5,010,114 | A | | 4/1991 | Liang et al. |
| 5,061,588 | A | | 10/1991 | Fushimi et al. |
| 5,225,303 | A | | 7/1993 | Tomita et al. |
| 5,314,777 | A | | 5/1994 | Watanabe et al. |
| 5,344,732 | A | | 9/1994 | Chiba et al. |
| 5,368,972 | A | | 11/1994 | Yamashita et al. |
| 5,403,690 | A | | 4/1995 | Kuramoto et al. |
| 5,418,103 | A | | 5/1995 | Muto et al. |
| 5,429,901 | A | | 7/1995 | Muto et al. |
| 5,514,511 | A | | 5/1996 | Iwamoto et al. |
| 5,545,381 | A | | 8/1996 | Iida et al. |
| 5,554,478 | A | | 9/1996 | Kuramoto et al. |
| 5,612,766 | A | | 3/1997 | Iida et al. |
| 5,652,079 | A | | 7/1997 | Mochizuki et al. |
| 5,659,860 | A | | 8/1997 | Sasaki et al. |
| 5,770,342 | A | | 6/1998 | Okae et al. |
| 5,771,426 | A | | 6/1998 | Oka et al. |
| 5,783,352 | A | * | 7/1998 | Okae et al. ..... 430/137.17 |
| 5,840,456 | A | | 11/1998 | Tomita et al. |
| 5,912,100 | A | | 6/1999 | Aoki et al. |
| 5,975,446 | A | | 11/1999 | Yaguchi et al. |
| 6,004,715 | A | | 12/1999 | Suzuki et al. |
| 6,010,814 | A | | 1/2000 | Kotsugai et al. |
| 6,033,820 | A | * | 3/2000 | Hayashi et al. ..... 430/108.22 |
| 6,074,794 | A | | 6/2000 | Fushimi et al. |
| 6,168,894 | B1 | | 1/2001 | Aoki et al. |
| 6,183,926 | B1 | | 2/2001 | Kuroda et al. |
| RE37,197 | E | | 5/2001 | Iida et al. |
| 6,258,502 | B1 | | 7/2001 | Nakamura et al. |
| 6,285,848 | B1 | | 9/2001 | Aita et al. |
| 6,303,257 | B1 | | 10/2001 | Hasegawa et al. |
| 6,303,258 | B1 | | 10/2001 | Katoh et al. |
| 6,329,115 | B1 | | 12/2001 | Yamashita |
| 6,356,729 | B1 | | 3/2002 | Sasaki et al. |
| 6,363,229 | B1 | | 3/2002 | Shiraishi et al. |
| 6,368,765 | B2 | | 4/2002 | Izu et al. |
| 6,406,826 | B1 | | 6/2002 | Suzuki et al. |
| 6,468,706 | B2 | | 10/2002 | Matsuda et al. |
| 6,472,118 | B1 | | 10/2002 | Yamaguchi et al. |
| 6,489,073 | B2 | | 12/2002 | Kotsugai et al. |
| 6,500,595 | B1 | | 12/2002 | Mochizuki et al. |

(Continued)

FOREIGN PATENT DOCUMENTS

| | | |
|---|---|---|
| EP | 1 380 791 A1 | 5/2003 |
| JP | 56-5443 | 1/1981 |
| JP | 56-113142 | 9/1981 |
| JP | 1-182856 | 7/1989 |
| JP | 4-211401 | 8/1992 |

(Continued)

OTHER PUBLICATIONS

U.S. Appl. No. 11/227,566, filed Sep. 16, 2005, Nagatomo et al.
U.S. Appl. No. 11/338,700, filed Jan. 25, 2006, Kotsugai et al.
U.S. Appl. No. 11/519,057, filed Sep. 12, 2006, Nakayama et al.
U.S. Appl. No. 11/558,736, filed Nov. 10, 2006, Osamu Uchinokura et al.
U.S. Appl. No. 11/868,618, filed Oct. 8, 2007, Sugiyama et al.

*Primary Examiner*—John L Goodrow
(74) *Attorney, Agent, or Firm*—Oblon, Spivak, McClelland, Maier & Neustadt, P.C.

(57) ABSTRACT

A toner for developing an electrostatic image, includes: a colorant; and a binder resin. The toner has a particle including at least one pore having a diameter of 10 nm or over, and a porosity thereof is in a range from 0.01 to 0.60.

18 Claims, 7 Drawing Sheets

U.S. PATENT DOCUMENTS 6,503,676 B2 1/2003 Yamashita et al.
6,503,681 B2 1/2003 Makino et al.
6,526,246 B2 2/2003 Iwata et al.
6,542,707 B2 4/2003 Muramatsu et al.
6,544,704 B1 4/2003 Matsuda et al.
6,566,026 B2 5/2003 Watanabe et al.
6,593,048 B2 7/2003 Sasaki et al.
6,597,883 B2 7/2003 Muramatsu et al.
6,599,672 B2 7/2003 Yamaguchi et al.
6,628,908 B2 9/2003 Matsumoto et al.
6,628,913 B2 9/2003 Matsumoto et al.
6,630,276 B2 10/2003 Sugiura et al.
6,653,037 B2 11/2003 Sawada et al.
6,660,443 B2 12/2003 Sugiyama et al.
6,667,141 B2 12/2003 Iwamoto et al.
6,696,213 B2 2/2004 Yamaguchi et al.
6,699,632 B2 3/2004 Higuchi et al.
6,716,561 B2 4/2004 Shiraishi et al.
6,733,939 B2 5/2004 Nanya et al.
6,735,409 B2 5/2004 Takahashi et al.
6,739,534 B2 5/2004 Yamaguchi et al.
6,743,558 B2 6/2004 Yamaguchi et al.
6,757,507 B2 6/2004 Mochizuki et al.
6,770,411 B2 8/2004 Masuda et al.
6,780,556 B2 8/2004 Sugiura et al.
6,790,575 B2 9/2004 Sasaki et al.
7,041,420 B2 * 5/2006 Vandewinckel et al. . 430/107.1
2001/0044059 A1 11/2001 Miyamoto et al.
2002/0006564 A1 1/2002 Kondou et al.
2002/0098436 A1 7/2002 Miyamoto et al.
2003/0138717 A1 7/2003 Yagi et al.
2003/0152857 A1 8/2003 Sugiura et al.
2004/0076901 A1 4/2004 Miyamoto et al.
2004/0115550 A1 * 6/2004 Sugiura et al. ..... 430/109.4
2005/0026064 A1 2/2005 Sugiura et al.

FOREIGN PATENT DOCUMENTS

JP 7-128904 5/1995
JP 10-142838 5/1998
JP 11-65281 3/1999
JP 2000-19775 1/2000
JP 2000-181131 6/2000
JP 2001-255690 9/2001
JP 2001-271006 10/2001
JP 2002-341615 11/2002
JP 2003-50477 2/2003
JP 2003-140381 5/2003
JP 2004-54204 2/2004
JP 2005-10368 1/2005

* cited by examiner

TONER FOR DEVELOPING ELECTROSTATIC IMAGE, DEVELOPER, IMAGE FORMING APPARATUS, PROCESS FOR FORMING IMAGE, PROCESS CARTRIDGE AND PROCESS FOR MEASURING POROSITY OF TONER

BACKGROUND OF THE INVENTION

1. Field of the Invention

The present invention relates to a toner for developing an electrostatic image, a developer, an image forming apparatus, a process for forming an image, a process cartridge, and a process for measuring porosity of the toner.

2. Description of the Related Art

In an electrophotographic device, an electrostatic recording device or the like, an electrostatic latent image is formed on a photoconductor, to which a toner is attracted. The toner is transferred to a transfer material, such as a sheet of paper, and then fused to the transfer material by heat and thus a toner image is formed. To form a full-color image, it is generally done by using four toners of different colors consisting of black, yellow, magenta, and cyan. Development is carried out for each color, each layer of toner is overlaid on the transfer material to form the toner image, and the toner image is then heated and simultaneously fused to obtain a full-color image.

In general, for a user who is accustomed to commercial prints such as offset lithographic prints, images created by full-color copiers are still not at a satisfactory level, and demands are high for further improving the quality to achieve the fineness and resolution that are comparable to those of photographic and offset prints. It is known that in order to improve the quality of an electrophotographic image, the diameters of toner particles are preferred to be small and the distribution of particle diameter is preferred to be narrow.

A latent image, either electric or magnetic, is made visible by toner. Toners used for developing an electrostatic image generally include colored particles comprising a colorant, a charge control agent, and other additives all in a binder resin. Processes for manufacturing toner can be categorized broadly into pulverization (grinding) and polymerization. Pulverization is a process in which a colorant, a charge control agent, an offset preventing agent, and the like are melted, mixed, and evenly dispersed in a thermoplastic resin, after which obtained composition is crushed into small particles and classified to obtain the toner. With pulverization, toners having somewhat favorable properties can be manufactured, but materials that can be used for the toners are limited. For instance, the composition made by melting and mixing is to be crushed and classified using an apparatus that is economically affordable. For this requirement, the composition after the melting and mixing is preferred to be sufficiently brittle. Therefore, when the composition is actually crushed into particles, the distribution of particle diameters tends to be wide spread. The drawback is that the yield may become extremely low when one tries to obtain a reproduced image with favorable resolution and tone because a portion of the toner particles, for example, minute particulates of 5 μm or less in diameter and large grains of 20 μm or more, is to be removed by classification. In addition, it is difficult in pulverization to evenly disperse a colorant, a charge control agent, and the like within a thermoplastic resin. Uneven dispersion of the agents and additive may adversely affect the flowability, developability, durability, image quality, and the like of the toner.

To overcome such problems in pulverization, toner particles are recently made by other processes such as suspension polymerization (refer to Japanese Patent Application Laid-Open (JP-A) No. 09-43909). However, toner particles manufactured by suspension polymerization have a drawback of poor cleanability although they are spherical. For development and transfer of low toner coverage image, there is little residual toner that is not transferred and therefore there is no concern of insufficient cleaning of toner. However, when the toner coverage of an image is high, e.g. a photographic image, a paper jam or the like may result in building up of non-transferred residual toner on a photoconductor on which toner is forming an image but not transferred. Accumulation of such residual toner leads to background shading. Moreover, residual toner contaminates components such as a charging roller, which charges a photoconductor by contact charging, and subsequently reduces the charging performance of the charging roller. Furthermore, concerns for toner particles formed by suspension polymerization include unsatisfactory fusibility at low temperatures and a large amount of energy required for fusion.

On the other hand, another process for manufacturing toner particles is disclosed in Japanese Patent (JP-B) No. 2537503 in which emulsion polymerization is used to form resin particulates, which are subsequently associated to obtain toner particles having irregular shapes. However, toner particles formed by emulsion polymerization have a large amount of residual surfactants inside the particles as well as on the surface thereof, even after being washed by water, which reduces the environmental stability of toner charge, increases the distribution of the amount of charge, and causes background shading on a printed image. In addition, the residual surfactant contaminates photoconductor, charging roller, developing roller, and other components, thus causing problems such as insufficient charging performance.

On the other hand, for the fusing process by contact heating, in which heating members such as a heating roller are used, the toner particles must possess releasability (which may be referred to as "offset resistance" hereinafter) from the heating members. In such case, the offset resistance can be improved by allowing a release agent to exist on the surface of the toner particles. In contrast, methods to improve offset resistance are disclosed in JP-A No. 2000-292973 and JP-A No. 2000-292978 in which resin particulates are not only contained in toner particles, but are concentrated at the surface of the toner particles. However, this approach brings up an issue in which the method increases the lower limit fusing temperature at which toner is fused and therefore is unsatisfactory in low temperature fusibility, i.e. energy-saving fusion.

In addition, this process, in which resin particulates obtained by emulsion polymerization are associated to provide irregular-shaped toner particles, has another problem. Generally, release agent particulates are additionally associated to improve the offset resistance. However, the release agent particulates are captured inside the toner particles and therefore the improvement of the offset resistance is not sufficient. Moreover, since each toner particle is formed by a random adhesion of resin particulates, release agent particulates, colorant particulates, and the like which are molten, the composition (the ratio at which each component is contained), molecular weight of the resin, and the like may be varied among obtained toner particles. As a result, the surface properties of toner particles are different from one another, and it is impossible to form stable images for a long period. Additionally, in a low-temperature fusing system, the resin particulates that are concentrated at the surface of the toner particles inhibit fusing and therefore the range of fusing temperature is not sufficient.

Recently, a new manufacturing process called emulsion-aggregation (EA) has been suggested (refer to JP-B No. 3141783). In this process, particles are formed from polymers that are dissolved in an organic solvent or the like whereas in suspension polymerization, particles are formed from monomers, and the emulsion-aggregation is said to be advantageous in that, for example, there is a larger selection of resins that can be used and polarity can be controlled. Furthermore, the emulsion-aggregation is said to be advantageous in that it is possible to control the structure of toner particles (core/shell structure control). However, the shell structure is a layer consisting only of a resin and the purpose thereof is to reduce the exposure of pigment and wax to the surface. The purpose is not to alter the structure in the resin, and the structure is not capable of achieving such purpose (from The 4th Joint Symposium of The Imaging Society of Japan and The Institute of Electrostatics Japan, 2002 Jul. 29). Therefore, although the toner particle has a shell structure, the surface of the toner particle is a usual resin without any ingenious feature so that when the toner particle is targeted at fusing at a lower temperature, it is not satisfactory from the standpoint of anti-heat preservability and environmental charge stability and this is a concern.

In any of the above-mentioned processes, that is, the suspension polymerization, the emulsion polymerization, and the emulsion-aggregation, styrene-acrylic resins are generally used. Polyester resins are difficult to be made into particles, and it is uneasy to control particle diameter, diameter distribution, and particle shape. Also, their fusibility is limited when the aim is for fusing at a lower temperature.

On the other hand, it is known that polyester modified by urea bonds is used for anti-heat preservability and low-temperature fusing (refer to JP-A No. 11-133667). However, the surface is not specially ingenious, and the environmental charge stability is not satisfactory especially when the conditions are harsh.

Much work has been done from various angles of approach in the field of electrophotography to improve image quality, and it is being more and more recognized that reducing the size and increasing the sphericity of the toner particle are extremely effective. However, as the diameter of toner particles becomes smaller, the transferability and fusibility tend to decrease, and image quality becomes poor. On the other hand, it is known that by making toner particles spherical, the transferability is improved (refer to JP-A No. 09-258474). In such situation, ever-faster image formation is desired in the field of color copiers and color printers. For the faster printing, the "tandem method" is effective (as disclosed in JP-A No. 05-341617). The "tandem method" is a method in which images formed by respective image forming units are sequentially transferred and overlaid on a single sheet of paper that is advanced by a transfer belt, so that a full-color image is obtained on the sheet. A color image forming apparatus using the tandem method is characterized in that various kinds of paper can be used, the quality of full-color images is high, and full-color images can be formed at high speed. The high-speed output of full-color images is especially characteristic and no other color image forming apparatuses have that characteristic. On the other hand, there are other attempts to increase the speed, while improving the image quality, by using spherical toner particles. However, while toner particles are needed to have quick fusibility in order to accommodate to high-speed output, no spherical toner particle with a good fusibility as well as low-temperature fusibility has been realized to date.

In addition, after the manufacture of a toner, environments during storage and transport, such as hot and humid, or low and dry, are severe for the toner. There are demands for a toner having an excellent preservability where toner particles do not coagulate even after being stored in such environments and degradation in chargeability, flowability, transferability, and fusibility is none or very little. However, especially for spherical toner particles, no effective way that is capable of overcoming such issues has been found to date.

Each of the conventional pulverized toner and the chemical (polymerized) toner is fully packed with toner composition, bringing about its performance ordinarily. However, it is difficult to satisfy the following two at the same time: i) prevention of degradation in developability and transferability such as charge stability, which degradation is involved in making the toner particle smaller, and ii) effect of smaller toner particle that the amount of the toner's adhesion to paper and the like per unit area is reduced (low M/A [mass area]), which effect has a significant weight. Therefore, such a method is preferred as to reduce the amount of the toner's adhesion (low M/A [mass area]) while keeping the toner particle diameter as small as possible and securing the developability, transferability, fusibility and the like.

SUMMARY OF THE INVENTION

It is therefore an object of the present invention to provide the following paragraph (1) to paragraph (6) which solve the above problems:

(1) A toner, an image forming apparatus and a process for forming an image that reduce the amount of toner's adhesion to paper and the like per unit area while securing developability, transferability, and fusibility, and that obtain image quality with sufficient image density.

(2) An image forming apparatus and a process for forming an image that secure sufficiently high charge performance of toner, bring about good charge rising property of toner, cause a small amount of toner spent to carrier and the like even when tens of thousands of images are outputted, maintain high chargeability and flowability, reduce background shading (fog), and bring about an image with sufficient density.

(3) A toner, a developer, an image forming apparatus, and a process for forming an image whose cleanability is maintained, that comply with low temperature fusing system, whose offset resistance is favorable, and that do not contaminate a fusing apparatus and an image.

(4) An image forming apparatus and a process for forming an image that form images with little background shading (fog) having excellent charge stability in hot and humid or cold and dry environment, and in which the toner's spreading out inside a machine is small in quantity.

(5) An image forming apparatus and a process for forming an image that are both highly durable and highly maintainable as an image forming system.

(6) A process for measuring porosity of the toner.

The inventors under the present invention have discussed intensively to solve the above issues and found out the following in connection with a toner including at least a colorant and a binder resin: use of the above toner having a particle including at least one pore having a diameter of 10 nm or over, a porosity thereof being in a range from 0.01 to 0.06, may reduce the amount of toner's adhesion to paper and the like per unit area while securing developability, transferability and fusibility and may obtain image quality with sufficient image density.

According to a first aspect of the present invention, there is provided a toner for developing an electrostatic image, comprising: a colorant; and a binder resin, wherein the toner has a particle comprising at least one pore having a diameter of 10 nm or over, and a porosity thereof is in a range from 0.01 to 0.60.

According to a second aspect of the present invention, the diameter of the at least one pore included in the particle of the toner is 50 nm or over.

According to a third aspect of the present invention, the diameter of the at least one pore included in the particle of the toner is 200 nm or over.

According to a fourth aspect of the present invention, the particle of the toner comprises ten or more pores, the diameter of each of the pores being 10 nm or over.

According to a fifth aspect of the present invention, the porosity is in a range from 0.01 to 0.50.

According to a sixth aspect of the present invention, the toner is constituted of a particle which is formed by a manufacturing process comprising: dispersing in a water medium an oil droplet of an organic solvent in which the toner's composition comprising a prepolymer is contained, and at least one of elongating and cross-linking of the prepolymer.

According to a seventh aspect of the present invention, the manufacturing process further comprises a degassing reaction.

According to an eighth aspect of the present invention, the prepolymer comprises an isocyanate-group, and an amine is used as at least one of an elongation agent and a cross-linking agent when the prepolymer is subjected to the at least one of the elongation process and the cross-linking process.

According to a ninth aspect of the present invention, the toner comprises at least a polyester resin.

According to a tenth aspect of the present invention, the toner comprises at least a modified polyester resin.

According to an eleventh aspect of the present invention, the toner further comprises an unmodified polyester resin.

According to a twelfth aspect of the present invention, the particle of the toner has an average sphericity E of 0.90 to 0.99.

According to a thirteenth aspect of the present invention, the particle of the toner has a sphericity SF-1 of 100 to 150 and a sphericity SF-2 of 100 to 140.

According to a fourteenth aspect of the present invention, the particle of the toner has a volume average particle diameter Dv of 2 μm to 7 μm and Dv/Dn of 1.25 or below which is a ratio of the volume average particle diameter Dv to a number average particle diameter Dn.

According to a fifteenth aspect of the present invention, the volume average particle diameter Dv of the particle of the toner is 4 μm to 7 μm.

According to a sixteenth aspect of the present invention, there is provided a two-component developer, comprising: a carrier made of a magnetic particle; and a toner for developing an electrostatic image, the toner comprising: a colorant, and a binder resin, wherein the toner has a particle comprising at least one pore having a diameter of 10 nm or over, and a porosity thereof is in a range from 0.01 to 0.60.

According to a seventeenth aspect of the present invention, there is provided an image forming apparatus, comprising: an electrostatic image carrier; a charging unit for charging the electrostatic image carrier; an exposing unit for making an exposure, in a form of an image, to the electrostatic image carrier charged by the charging unit to thereby form an electrostatic image; a developing unit packed with a developer, and developing with the developer the electrostatic image on the electrostatic image carrier to thereby form a toner image; and a transfer unit abutting on a surface of the electrostatic image carrier via a transfer material and transferring the toner image to the transfer material, wherein the developer is a two-component developer comprising: a carrier made of a magnetic particle, and a toner for developing the electrostatic image, the toner comprising: a colorant, and a binder resin, wherein the toner has a particle comprising at least one pore having a diameter of 10 nm or over, and a porosity thereof is in a range from 0.01 to 0.60.

According to an eighteenth aspect of the present invention, there is provided a process for forming an image, comprising: charging an electrostatic image carrier; exposing, in a form of an image, to the electrostatic image carrier charged by the charging to thereby form an electrostatic image; developing with a developer the electrostatic image on the electrostatic image carrier to thereby form a toner image; and transferring the toner image to a transfer material by allowing a transfer unit to abut on a surface of the electrostatic image carrier via the transfer material and, wherein the developer comprises: a colorant, and a binder resin, wherein a toner has a particle comprising at least one pore having a diameter of 10 nm or over, and a porosity thereof is in a range from 0.01 to 0.60.

According to a nineteenth aspect of the present invention, there is provided a process cartridge, comprising: an electrostatic image carrier; and at least one of the following: a developing unit packed with a developer, and developing with the developer an electrostatic image on the electrostatic image carrier to thereby form a toner image, a charging unit for charging the electrostatic image carrier, and a cleaning unit for removing a toner remaining after a transfer on a surface of the electrostatic image carrier, so as to form an integrated structure, wherein the process cartridge is adapted to be attached to and detached from a main body of an image forming apparatus, wherein the developer comprises: a colorant, and a binder resin, wherein the toner has a particle comprising at least one pore having a diameter of 10 nm or over, and a porosity thereof is in a range from 0.01 to 0.60.

According to a twentieth aspect of the present invention, there is provided a process for measuring a porosity of a toner, comprising: irradiating a focused ion beam to the toner which is conductivity-treated and is held on a support body; forming the toner's cross section having a thickness of 100 nm to 300 nm; and calculating a pore area of the toner's cross section.

A mechanism is presently being clarified in which a toner having a particle including therein at least one pore having a diameter of 10 nm or over, a porosity thereof being in a range from 0.01 to 0.06, may reduce the amount of toner's adhesion to paper and the like per unit area and satisfy image density while securing developability, transferability and fusibility. In connection with the above, the following is assumed from some analyzed data:

In the toner particle, the presence of at least one pore having a diameter of 10 nm or over can reduce the toner's mass to toner's apparent volume, and can reduce the amount of toner's adhesion to paper and the like while securing chargeability, transferability and fusibility with the toner kept in a certain size. Excessively reducing the toner particle diameter (for example, 1 μm) may achieve a like reduction of the adhesion. In this case, however, controlling the 1 μm particle in a drying method was conventionally extremely difficult and even impossible. From a standpoint of reduction rate of toner's mass, the pore preferably has diameter of 50 nm or over, more preferably 200 nm or over, and the number of pores is preferably 2 or over, more preferably 10 or over.

The porosity is defined as a quantity that characterizes porous substance, and is denoted by V/Vt where Vt stands for a total volume of a given substance and V stands for occupation by the pore. In general, the V/Vt can be obtained through a measurement of: i) a specific gravity of a substance including the pore (apparent specific gravity) and ii) a specific gravity excluding the pore (true specific gravity). In the case of a particle such as toner, however, which has uneven surface form and therefore an influence of a surface state of the pore is dominant, calculating the pore from the apparent specific gravity is of difficulty. Contrary to the above, a process for measuring the porosity under the present invention can calculate a hollow ratio in the toner particle (namely, porosity) from an area ratio (volume ratio) of the pores in the toner's cross section. For calculating the porosity, adopting an average of about five particles in the toner is preferred. A commercially available image processing software, for example, Luzex, Image Plus Pro, and the like is usable for calculating the area ratio (namely, volume ratio). In connection with the toner for developing electrostatic image under the present invention, the following area ratio is adopted for the toner porosity: a focused ion beam is irradiated to the toner which has been conductivity-treated and is held on a support body, then an ultra-thin toner cross section of 100 nm to 300 nm thick is formed, then calculating a pore area of the cross section relative to a total cross section can define the area ratio of the toner porosity.

The porosity below 0.01 is not preferable since the effect of the pore is degraded which is reducing of the toner's mass relative to the apparent volume of the toner particle, thus the original purpose may be not achieved. The porosity over 0.60 is also not preferable, since forming the toner particle and keeping the shape of the toner particle may become difficult, thus causing collapse of the particles and the like attributable to development stress and the like, and further thus causing carrier spent and the like.

The porous toner can be produced in the following states:

The porous toner for developing an electrostatic image is constituted of a particle which is formed by a manufacturing process including: 1) dispersing in a water medium (aqueous phase) an oil droplet of an organic solvent in which the toner's composition including a prepolymer is included; and ii) at least one of elongating and cross-linking of the prepolymer, and during the formation of the particle, the solvent is included in the particle and it becomes volatilized.

Moreover, the porous toner can be produced in the following manner:

When a generation reaction of polyurethane and a generation reaction of polyurea by adding isocyanate and glycol or by adding isocyanate and diamine are included, the isocyanate may also react with even a small amount of water to generate carbamic acid. The carbamic acid which is so unstable to heat may immediately cause decarboxylation to become an amine derivative, to thereby produce the porous toner.

$$R\text{-}NCO + H_2O \rightarrow [R\text{-}NH\text{-}COOH]\text{(carbamic acid)} \rightarrow R\text{-}NH_2 + CO_2\uparrow$$

A technology known as what is called a urethane foam (foaming body) partly used for controlling a degassing reaction process (solvent, carbon dioxide gas, water, air and the like) from inside the oil droplet is preferable, since it allows a hollow-state control.

The toner for developing an electrostatic image includes at least a polyester resin, thus allowing resin's elasticity and degassing to better control the hollow state, which is more preferable.

The toner for developing an electrostatic image includes at least a modified polyester resin, thus allowing resin's elasticity and degassing to better control the hollow state, which can reinforce reduced toner hardness attributable to the presence of the pore, which is more preferable.

The toner for developing an electrostatic image with the particle having an average sphericity E of 0.90 to 0.99 can achieve further uniform degassing, thus making the hollow state more controllable and securing the toner hardness by the spherifying, which is more preferable.

The toner for developing an electrostatic image with the particle having a sphericity SF-1 of 100 to 150 and a sphericity SF-2 of 100 to 140 can achieve further uniform degassing, thus making the hollow state more controllable and securing the toner hardness by the spherifying, which is more preferable.

The toner for developing an electrostatic image with the particle having a volume average particle diameter Dv of 2 μm to 7 μm and Dv/Dn of 1.25 or below which is a ratio of the volume average particle diameter Dv to a number average particle diameter Dn can achieve uniform degassing while securing chargeability, transferability and fusibility of the toner, thus allowing degassing to further better control the hollow state, which is more preferable.

The two-component developer, comprising: a carrier made of a magnetic particle; and a toner for developing an electrostatic image can, by a short-time frictional electrification, secure a sufficient rising capability of reduced toner hardness attributable to the presence of the pore, thus keeping a narrow distribution of the amount of charge without collapsing toner shape, which is more preferable.

The following area ratio is adopted for the toner porosity: a focused ion beam is irradiated to the toner which has been conductivity-treated and is held on a support body, then an ultra-thin toner cross section of 100 nm to 300 nm thick is formed, then calculating a pore area of the cross section relative to a total cross section can define the area ratio of the toner porosity. Methods for observing the pore after forming the cross section include a transmission electron microscope (TEM), scanning transmission electron microscope (STEM), scanning electron microscope (SEM), scanning probe microscope (SPM), atomic force microscope (AFM) and the like, but not limited thereto. Compared with a conventional microtome cutting ultra-thin sample forming method and the like, the above methods are epochal in that they cause drastically small damage to the sample. Particularly, machining the toner having low temperature fusibility, low viscosity and pores with the conventional microtome cutting ultra-thin sample forming method may deform the toner and smash pores, making inside toner unable to observe.

DESCRIPTION OF THE PREFERRED EMBODIMENTS

Figure 1:
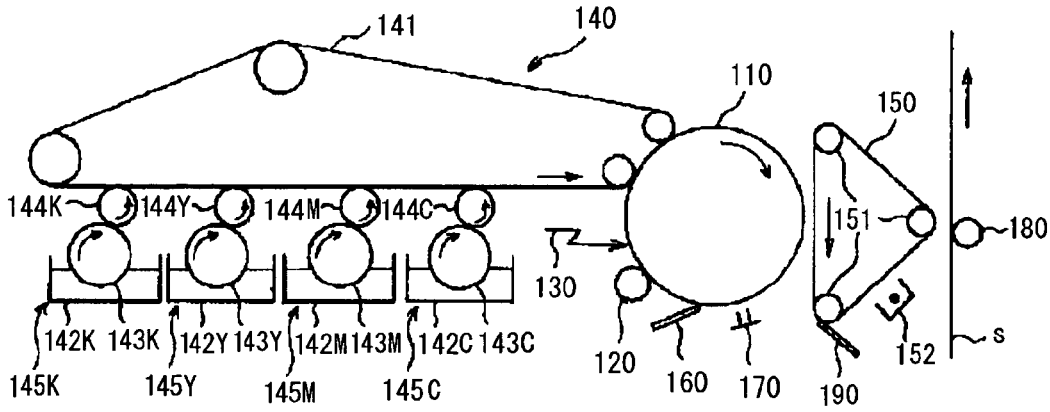
FIG. 1 is a schematic view of an example of an image forming method, according to an embodiment of the present invention.

The present invention will be described in detail hereinafter. It is to be understood that any well known manufacturing process, material, system, and the like can be used for a toner, developer, and electrophotographic process of the present invention if conditions are met.

(Average Sphericity E)

It is important for a toner of the present invention to have a specific shape and certain distribution of shapes, and it is preferred that the average sphericity E is from 0.90 to 0.99. If the sphericity of a toner is less than 0.90 and the shape thereof is far from a sphere and irregular, sufficient transferability and dust-free high quality images cannot be obtained. If the sphericity of a toner is more than 0.99, the toner particles are perfect spheres, and cleanability is adversely affected. Therefore, it is not preferable. To measure the shape of toner particles, it is suitable to use an optical detection method in which a suspension containing the particles is passed through an image detection unit on a plate, and a CCD camera optically captures an image of particles to analyze the particles. By using the method, a projected area of a toner particle can be measured. The average sphericity E is calculated by dividing the perimeter of a circle (circumference) having the same projected area with the perimeter of the toner particle as an actual toner particle. More preferably, the average sphericity E of a toner is from 0.94 to 0.99, so that the toner can form properly reproduced, fine images of appropriate density. With regards to easiness of cleaning, it is more suitable if the average sphericity E is from 0.94 to 0.99 and not more than 10% of all the particles have the sphericity less than 0.94.

An average sphericity E can be measured by using a flow particle image analyzer FPIA-1000 (Toa Medical Electronics). Specifically describing the measurement process, first, to a container filled with 100 ml to 150 ml of water from which solid impurities are removed beforehand, a surfactant, preferably 0.1 ml to 0.5 ml of alkylbenzenesulfonate, is added as a dispersing agent, and 0.1 g to 0.5 g of testing sample is further added. Using a supersonic dispersing device, the suspension in which the sample is dispersed is treated (dispersion) for about 1 to 3 minutes to allow the particle concentration to be from 3,000 particles/μl to 10,000 particles/μl. Then, the flow particle image analyzer is used to measure the shape and the distribution of the toner sample to obtain the average sphericity E.

(Sphericity SF-1 and SF-2)

Shape coefficients SF-1 and SF-2 are sphericity factors for the present invention, which coefficients are measured as follows. An S-4200 field emission scanning electron microscope (FE-SEM available from Hitachi Ltd.) is used to obtain SEM images of toner particles. Then, 300 images are randomly sampled, and the information of the images is introduced to a Luzex AP image analyzer (Nireco Corporation) through an interface and analyzed by the Luzex AP image analyzer. Then, using the following formulae, SF-1 and SF-2 are defined. It is preferred that SF-1 and SF-2 are measured using a Luzex analyzer, but as far as the same analysis can be made, devices being used are not limited to the above-mentioned FE-SEM and Luzex AP image analyzer.

$$SF\text{-}1=(L^2/A)\times(\pi/4)\times 100$$

$$SF\text{-}2=(P^2/A)\times(1/4\pi)\times 100$$

where "L" is the absolute maximum length of a toner particle, "A" is the projected area of a toner, and "P" is the maximum perimeter of a toner.

For a sphere, both values are 100, and as the values increase, a shape is deformed from a sphere to an irregular shape. Specifically, SF-1 is a shape coefficient that reflects the overall shape of a toner (whether it is more like an ellipsoid or a sphere) and SF-2 is another shape coefficient that reflects the degree of asperity on the surface.

SF-1 reflects circularity and ellipticity of the toner's cross section. As the SF-1 increases, the toner becomes more deviated from sphere. SF-1 over 150 may decrease the toner's transferability, thus unpreferably decreasing the image density or unpreferably causing rough image or a dropout of thin line. SF-2 reflects irregularities of the toner's surface. SF-2 over 140 may also decrease the toner's transferability, thus unpreferably decreasing the image density or unpreferably causing rough image or a dropout of thin line.

(Average Particle Diameter Ratio Dv/Dn (Ratio of Volume Average Particle Diameter to Number Average Particle Diameter))

It is preferable that the Volume average particle diameter (Dv) of toner particles of the present invention is from 2 μm to 7 μm (More preferably, 4 μm to 7 μm.) and the ratio of the Volume average particle diameter (Dv) to the Number average particle diameter (Dn), Dv/Dn, is 1.25 or below, more preferably between 1.10 and 1.25 inclusive. If the ratio is in the preferred range, the dry toner is excellent in all of anti-heat preservability, low-temperature fusibility, and hot offset resistance. Especially, when used in a full-color copier and the like, images have excellent gloss. Moreover, in a two-component developer, the fluctuation of toner particle diameter in the developer is reduced even after consumption and replenishment of toner is carried out for a long period of time, and good and stable development is achieved after a long term agitation by a developing unit. In addition, when used as a single-component developer, the fluctuation of toner particle diameter is reduced even after consumption and replenishment of toner is carried out, and there is no filming of toner to a developing roller and no adhesion of molten toner to members such as a blade for making a thin layer of toner. Furthermore, good and stable development is achieved and quality images are obtained, even after a long term use (agitation) of a developing unit. Especially, when the toner has, as fluidization agent, particulates which are surface-treated by both fluorine-containing compound and silicon-containing compound, the toner may have good distribution of particle diameters since the fluorine-group may reduce allowance for the filming.

It is said that, generally, the smaller the diameter of toner particles is, the more advantageous it is to obtain high resolution and high quality images. However, it is, on the contrary, disadvantageous with regards to transferability and cleanability. Moreover, if the Volume average particle diameter is less than the preferred range of the present invention, in a two-component developer, molten toner particles adhere to the surface of carrier particles after a long term agitation in an image-developer device, degrading the charge performance of the carrier particles. When used as a single-component developer, filming of toner to developing roller and adhesion of molten toner to members such as a blade for making a thin layer of toner are more likely to occur. These phenomena are also observed from a toner that has higher ratio of small toner particles therein than the preferred range of the present invention.

On the other hand, if the diameter of toner particles is larger than the preferred range of the present invention, it becomes difficult to obtain high resolution and high quality images, and in many cases the fluctuation of toner particle diameters is larger when the toner in a developer is consumed and replenished. In addition, it has been discovered that the same applies to a case in which the ratio Dv/Dn is larger than 1.25.

(Modified Polyester Resin)

For a toner of the present invention, modified polyester resins as described hereinafter can be used as the prepolymer. For example, it is possible to use polyester prepolymers having one or more isocyanate groups. Such isocyanate group-containing polyester prepolymers (A) can be made, for example, from a polyester that is a polycondensation product of a polyol (1) and a polycarboxylic acid (2) and that contains active hydrogen-containing group, which is then reacted with a polyisocyanate (3). The active hydrogen-containing group of the above polyester includes a hydroxyl group (an alcoholic hydroxyl group and phenolic hydroxyl group), amino group, carboxylic group, mercapto group, and the like, among which an alcoholic hydroxyl group is preferred.

Polyols (1) include diol (1-1) and polyols having three or more hydroxyl groups (1-2), and it is preferable to use (1-1) alone, or a mixture of (1-1) and a small amount of (1-2). Diols (1-1) include alkylene glycols (ethylene glycol, 1,2-propylene glycol, 1,3-propylene glycol, 1,4-butane diol, 1,6-hexane diol, and the like); alkylene ether glycols (diethylene glycol, triethylene glycol, dipropylene glycol, polyethylene glycol, polypropylene glycol polytetramethylene ether glycol, and the like); alicyclic diols (1,4-cyclohexane dimethanol, hydrogenated bisphenol A, and the like); bisphenols (bisphenol A, bisphenol F, bisphenol S, and the like); adducts of alicyclic diols with alkylene oxides (ethylene oxide, propylene oxide, butylene oxide, and the like); adducts of bisphenols with alkylene oxides (ethylene oxide, propylene oxide, butylene oxide, and the like); and the like. Among these, alkylene glycols having 2 to 12 carbon atoms and adducts of bisphenols with alkylene oxides are preferred, and particularly preferred are adducts of bisphenols with alkylene oxides and a mixture thereof with alkylene glycols having 2 to 12 carbon atoms. Polyols having three or more hydroxyl groups (1-2) include polyhydric aliphatic alcohols having 3 to 8 or more hydroxyl groups (glycerin, trimethylolethane, trimethylolpropane, pentaerythritol, sorbitol, and the like); phenols having 3 or more hydroxyl groups (trisphenol PA, phenol novolac, cresol novolac, and the like); adducts of polyhydric phenols having 3 or more hydroxyl groups with alkylene oxides; and the like.

Polycarboxylic acids (2) include dicarboxylic acids (2-1), polycarboxylic acids having 3 or more hydroxyl groups (2-2), and the like, and it is preferable to use (2-1) alone, or a mixture of (2-1) and a small amount of (2-2). Dicarboxylic acids (2-1) include alkylene dicarboxylic acids (succinic acid, adipic acid, sebacic acid, and the like); alkenylene dicarboxylic acids (maleic acid, fumaric acid, and the like); aromatic dicarboxylic acids (phthalic acid, isophthalic acid, terephthalic acid, naphthalene dicarboxylic acid, and the like); and the like. Among these, alkenylene dicarboxylic acids having 4 to 20 carbon atoms and aromatic dicarboxylic acids having 8 to 20 carbon atoms are preferable. Polycarboxylic acids having 3 or more hydroxyl groups (2-2) include aromatic polycarboxylic acids having 9 to 20 carbon atoms (trimellitic acid, pyromellitic acid, and the like) and the like. It is of note that polycarboxylic acids (2) may be replaced with an acid anhydride or a lower alkyl ester (methyl ester, ethyl ester, isopropyl ester, or the like) of the above-described carboxylic acids to be reacted with polyols (1).

The ratio of a polyol (1) to a polycarboxylic acid (2), by the equivalent ratio of hydroxyl groups (OH) to carboxyl groups (COOH), which is [OH]/[COOH], is typically 2/1 to 1/1, preferably 1.5/1 to 1/1, more preferably 1.3/1 to 1.02/1.

Polyisocyanates (3) include aliphatic polyisocyanates (tetramethylene diisocyanate, hexamethylene diisocyanate, 2,6-diisocyanate methylcaproate, and the like); alicyclic polyisocyanates (isophorone diisocyanate, cyclohexylmethane diisocyanate, and the like); aromatic diisocyanates (tolylene diisocyanate, diphenylmethane diisocyanate, and the like); aromatic aliphatic diisocyanates ($\alpha,\alpha,\alpha',\alpha'$-tetramethylxylene diisocyanate and the like); isocyanurates; above-mentioned polyisocyanates blocked with a phenol derivative, an oxime, caprolactum, or the like; and combinations of two or more of these.

The ratio of a polyisocyanate (3), by the equivalent ratio of isocyanate groups (NCO) to hydroxyl groups (OH) of the polyester, which is [NCO]/[OH], is typically 5/1 to 1/1, preferably 4/1 to 1.2/1, more preferably 2.5/1 to 1.5/1. When the ratio [NCO]/[OH] is more than 5, low-temperature fusibility is degraded. When the molar ratio of [NCO] is less than 1, the amount of urea in the modified polyester is low and thus adversely affect hot offset resistance. The amount of polyisocyanate (3) component in an isocyanate group-containing prepolymer (A) (containing at an end) is typically 0.5% by weight to 40% by weight, preferably 1% by weight to 30% by weight, more preferably 2% by weight to 20% by weight. If the amount is less than 0.5% by weight, hot offset resistance is lowered and it is disadvantageous with regards to satisfying anti-heat preservability and low-temperature fusibility at the same time. If the amount is more than 40% by weight, low-temperature fusibility is reduced.

The number of isocyanate groups contained in each molecule of isocyanate group-containing prepolymer (A) is typically 1 or more, preferably 1.5 to 3 in average, more preferably 1.8 to 2.5 in average. If it is less than 1 per molecule, the molecular weight of the modified polyester after cross-linking and/or elongation is reduced and therefore hot offset resistance is degraded.

The toner under the present invention preferably contains the modified polyester, as binder resin, which polyester can react (cross-linking and/or elongation) the isocyanate-group containing polyester prepolymer (A) in water medium (aqueous phase).

(Cross-linking Agent and Elongation Agent)

Amines can be used as a cross-linking agent and/or elongation agent for the present invention. Amines (B) include diamines (B1), polyamines having 3 or more amino groups (B2), amino alcohols (B3), amino mercaptans (B4), amino acids (B5), derivatives of B1 to B5 in which the amino groups are blocked (B6), and the like. Diamines (B1) include aromatic diamines (phenylene diamine, diethyltoluene diamine, 4,4'-diaminodiphenylmethane, and the like); alicyclic diamines (4,4'-diamino-3,3'-dimethyldicyclohexylmethane, diaminocyclohexane, isophoronediamine, and the like); aliphatic diamines (ethylenediamine, tetramethylenediamine, hexamethylenediamine, and the like); and the like. Polyamines having 3 or more amino groups (B2) include diethylenetriamine, triethylenetetramine, and the like. Amino alcohols (B3) include ethanolamine, hydroxyethylaniline, and the like. Amino mercaptans (B4) include aminoethyl mercaptan, aminopropyl mercaptan, and the like. Amino acids (B5) include amino propionic acid, amino caproic acid, and the like. Derivatives of B1 to B5 in which the amino groups are blocked (B6) include ketimine compounds and oxazoline compounds that are obtained from amines of B1 to B5 and ketones (acetone, methylethylketone, methylisobutylketone, and the like), and other compounds. Among these amines (B), B1 and a mixture of B1 and a small amount of B2 are preferable.

Additionally, an inhibitor can be used for cross-linking and elongation, if needed, to adjust the molecular weight of the modified polyester after the reaction. Inhibitors include monoamines (diethylamine, dibutylamine, butylamine, laurylamine, and the like), those that are blocked (ketimine compounds), and the like.

The ratio of amines (B) by the equivalent ratio of isocyanate groups [NCO] in the isocyanate group-containing prepolymer (A) to amino groups [NHx] in the amine (B), which is [NCO]/[NHx], is typically 2/1 to 1/2, preferably 1.5/1 to 1/1.5, more preferably 1.2/1 to 1/1.2. If the ratio [NCO]/[NHx] is more than 2 or less than 1/2, the molecular weight of the urea modified polyester (i) will be low and its hot offset resistance will be degraded.

(Unmodified Polyester)

For the present invention, the modified polyester (A) can be used alone, but an important use is to use an unmodified polyester (C) included as a toner binder component in addition to (A). By using (C) with (A), low-temperature fusibility and the gloss of images (which gloss is obtained when the toner is used in a full-color device) are improved. Examples of (C) include the same polyester components of (A), which are condensation polymerization products of polyols (1) and polycarboxylic acids (2), and preferred examples are also the same as those of (A). In addition to an unmodified polyester, (C) can also be a polyester modified by a chemical bond other than a urea bond, for example, a urethane bond. It is preferable from the standpoint of low-temperature fusibility and hot offset resistance that (A) and (C) form a mixture that is compatible at least in a portion thereof. Therefore, it is preferred that the polyester component of (A) and (C) have similar compositions. In the mixture, the weight ratio of (A) to (C) is typically 5/95 to 75/25, preferably 10/90 to 25/75, more preferably 12/88 to 25/75, and particularly preferably 12/88 to 22/78. When the weight ratio of (A) is less than 5%, hot offset resistance is degraded, and it is disadvantageous with regards to satisfying anti-heat preservability and low-temperature fusibility at the same time.

The peak molecular weight of (C) is typically from 1,000 to 30,000, preferably from 1,500 to 10,000, more preferably from 2,000 to 8,000. When it is lower than 1,000, anti-heat preservability is degraded, and when it is higher than 30,000, low-temperature fusibility is degraded. The hydroxyl value of (C) is preferably 5 or more, more preferably 10 to 120, and particularly preferably 20 to 80. When the hydroxyl value is less than 5, it is disadvantageous with regards to satisfying anti-heat preservability and low-temperature fusibility at the same time. The acid value of (C) is typically 0.5 to 40, preferably 5 to 35. By allowing (C) to have a preferred acid value, it is more likely that (C) becomes negatively chargeable. If either the acid value or hydroxyl value of a compound of (C) is not in the preferred range, it is subject to environmental effects in hot and humid or cold and dry environments, and therefore is likely to result in poor quality images.

The glass transition temperature (Tg) of the toners of the present invention is typically from 40° C. to 70° C., preferably 45° C. to 55° C. When it is lower than 40° C., the anti-heat preservability of the toner is degraded, and when it is higher than 70° C., the low-temperature fusibility becomes insufficient. Due to the coexistence of the polyester resin that is cross-linked and/or elongated, the toners of the present invention for developing an electrostatic image exhibit better preservability even if their glass transition temperature is low, compared with well known polyester toners. Regarding the storage elasticity modulus of a toner, the temperature (TG') at which the storage elasticity modulus is 10,000 dyne/cm2 at a measured frequency of 20 Hz, is typically 100° C. or higher, preferably 110° C. to 200° C. When it is lower than 100° C., hot offset resistance is degraded. Regarding the viscosity of a toner, the temperature (Tη) at which the viscosity is 1,000 poises at a measured frequency of 20 Hz, is typically 180° C. or lower, preferably 90° C. to 160° C. When it is higher than 180° C., low-temperature fusibility is degraded. Therefore, from the viewpoint of satisfying both low-temperature fusibility and hot offset resistance at the same time, TG' is preferably higher than Tη. In other words, the difference of TG' and Tη is preferably 0° C. or more. It is more preferably 10° C. or more, and is particularly preferably 20° C. or more. There is no particular limitation as to the upper limit of the difference. From the viewpoint of satisfying both anti-heat preservability and low-temperature fusibility at the same time, the difference of Tη and Tg is preferably 0° C. to 100° C., more preferably 10° C. to 90° C. and particularly preferably 20° C. to 80° C.

(Colorant)

For a colorant of the present invention, any dye or pigment well known in the art can be used. Examples of the colorant include carbon black, nigrosine dye, iron black, naphthol yellow S, Hanza yellow (10G, 5G, G), cadmium yellow, yellow iron oxide, ocher, chrome yellow, titanium yellow, polyazo yellow, oil yellow, Hanza yellow (GR, A, RN, R), pigment yellow L, benzidine yellow (G, GR), permanent yellow (NCG), Balkan fast yellow (5G, R), tartrazine lake, quinoline yellow lake, anthracene yellow BGL, isoindolinone yellow, red iron oxide, minium, lead vermilion, cadmium red, cadmium mercury red, antimony vermilion, Permanent-Red 4R, Para Red, Fire Red, p-chloro-o-nitroaniline red, risol fast scarlet G, brilliant fast scarlet, Brilliant Carmine BS, permanent red (F2R, F4R, FRL, FRLL, F4RH), fast scarlet VD, Vulcan Fast Rubine B, brilliant scarlet G, Lithol Rubine GX, permanent-Red F5R, brilliant carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, rhodamine lake B, rhodamine lake Y, alizarin lake, Thioindigo Red B, Thioindigo Maroon, oil red, quinacridone red, pyrazolone red, polyazo red, chrome vermilion, benzidine orange, Perynone Orange, oil orange, cobalt blue, cerulean blue, alkali blue lake, peacock blue lake, Victoria blue lake, non-metallic phthalocyanine blue, phthalocyanine-blue, fast sky blue, Indanthrene Blue (RS, BC), indigo, ultramarine blue, Berlin blue, anthraquinone blue, fast violet B, methyl violet lake, cobalt purple, manganese purple, dioxane violet, anthraquinone violet, chrome green, zinc green, chrom oxide, viridian, emerald green, pigment green B, naphthol green B, green gold, acid green lake, malachite-green lake, phthalocyanine green, anthraquinone green, titanium oxide, zinc white, lithopone, and mixtures thereof, and the like. The content of the colorant is typically 1% by weight to 15% by weight, and is preferably 3% by weight to 10% by weight, relative to the toner.

A colorant of the present invention can be combined with a resin and used as a masterbatch. For the manufacture of a masterbatch, various materials can be used as a binder resin that is kneaded with a colorant, in addition to the modified and unmodified polyesters mentioned above, for example, polymers of styrene or substituted styrenes such as polystyrene, poly p-chlorostyrene, polyvinyl toluene, and the like; styrene copolymers such as styrene-p-chlorostyrene copolymer, styrene-propylene copolymer, styrene-vinyltoluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinylmethylketone copolymer, styrene-butadiene copolymer, styrene-isoprene copolymer, styrene-acrylonitrile-indene copolymer, styrene-maleic acid copolymer, styrene-maleate copolymers, and the like; polymethylmethacrylate, polybutylmethacrylate, polyvinyl chloride, polyvinyl acetate, polyethylene, polypropylene, polyester, epoxy resins, epoxy polyol resins, polyurethanes, polyamides, polyvinyl butyral, polyacrylic resins, rosin, modified rosin, terpene resin, aliphatic or alicyclic hydrocarbon resins, aromatic petroleum resins, chlorinated paraffin, paraffin wax, and the like. These may be used either alone or in combination of two or more.

The masterbatch can be obtained by mixing and kneading a resin for masterbatch with a colorant by applying a high shear force. In order to enhance the interaction between the colorant and the resin, an organic solvent may be used. Also, the so-called flushing method may be used in which an aqueous paste of a colorant that contains water is mixed and kneaded together with a resin and an organic solvent, thereby transferring the colorant to the resin, and the water and organic solvent components are removed thereafter. The flushing method is preferred because a wet cake of the colorant can be used directly and there is no need for drying. For the mixing and kneading, a high shear dispersing machine such as a three roller mill or the like is preferably used.

Wax may be included in addition to a toner binder and colorant. The wax may be any of those known in the art. Examples of the wax include polyolefin waxes (polyethylene wax, polypropylene wax, and the like); long chain hydrocarbons (paraffin wax, Sasol wax, and the like); carbonyl group-containing waxes, and the like. Of these, the carbonyl group-containing waxes are preferred. Examples of the carbonyl group-containing waxes include polyalkane acid esters (carnauba wax, montan wax, trimethylolpropane tribehenate, pentaerythritol tetrabehenate, pentaerythritol diacetate dibehenate, glyceryl tribehenate, 1,18-octadecanediol distearate, and the like); polyalkenol esters (trimellitic acid tristearyl, distearyl maleate, and the like); polyalkane acid amides (ethylenediamine dibehenylamide, and the like); polyalkylamides (trimellitic tristearylamides, and the like); dialkyl ketones (distearylketone, and the like), and the like. Of the carbonyl group-containing waxes, the polyalkane acid esters are preferred.

The melting point of the wax used in the present invention is typically 40° C. to 160° C., preferably 50° C. to 120° C., and more preferably 60° C. to 90° C. If the melting point of the wax is less than 40° C., there is an adverse effect on anti-heat preservability. If the melting point of the wax is more than 160° C., cold offset during fusing tends to occur at low temperature. Further, the melt viscosity of the wax at a temperature 20° C. higher than the melting point is preferably 5 cps to 1,000 cps, more preferably 10 cps to 100 cps. If the melt viscosity of the wax is more than 1,000 cps, there is not much improvement of hot offset resistance and low-temperature fusibility. The content of the wax in the toner is typically 0% by weight to 40% by weight, preferably 3% by weight to 30% by weight.

(Charge Control Agent)

A toner of the present invention may further contain a charge control agent if needed. Any of the charge control agents known in the art may be used. Examples of the charge control agent include negrosine dyes, triphenylmethane dyes, chrome-containing metal complex dyes, molybdic acid chelate dyes, rhodamine dyes, alkoxy amines, quaternary ammonium salts (including fluorinated quaternary ammonium salts), alkyl amides, phosphorus and its compounds, tungsten and its compounds, fluorine activating agents, metal salicilates, metal salts of salicylic acid derivatives, and the like. Specific examples are Bontron 03 as the negrosine dye, Bontron P-51 as the quaternary ammonium salt, Bontron S-34 as the alloy metal azo dye, oxynaphthoic acid metal complex E-82, the salicylic acid metal complex E-84, the phenolic condensate E-89 (available from Orient Chemical Industries), the quaternary ammonium salt molybdenum complexes TP-302, TP-415 (available from Hodogaya Chemical Industries), the quaternary ammonium salt Copy Charge PSY VP2038, the triphenylmethane derivative Copy Blue PR, the quaternary ammonium salts Copy Charge NEG VP2036 and Copy Charge NX VP434 (available from Hoechst), LRA-901, LR-147 as the boron complex (available from Japan Carlit Co., Ltd.), copper phthalocyanine, perylene, quinacridone, azo pigments, and other polymer compounds containing a functional groups such as sulfonic acid group, carboxyl group, quaternary ammonium salt, and the like.

The amount of the charge control agent in the present invention is determined according to the type of the binder resin, the presence or absence of additives that are used if necessary, and the process for manufacturing the toner including the dispersion method, and therefore there is no universal limitation. However, the amount of the charge control agent is preferably 0.1 parts by weight to 10 parts by weight relative to 100 parts by weight of the binder resin, more preferably 0.2 parts by weight to 5 parts by weight. If it is more than 10 parts by weight, the chargeability of the toner is excessively large, the effect of the main charge control agent is diminished, the electrostatic attraction with the developing roller increases, resulting in a degradation in flowability of the developer and decrease of image density. These charge control agents may be melt-kneaded together with the master batch and resin and thereafter dissolved and/or dispersed, may naturally be added upon dissolution or dispersion directly in an organic solvent, or may be fixed on the surface of toner particles after the particles are formed.

(Auxiliary Additive)

Other than oxide particulates, inorganic particulates or hydrophobicized inorganic particulates can preferably be used as auxiliary additive that complements flowability, developability, and chargeability of the colored particles of the present invention. The primary particle diameter of the hydrophobicized particulates is preferably 1 nm to 100 nm in average, more preferably one or more types of inorganic particulars of 5 nm to 70 nm are included. Particularly preferably, the primary particle diameter of the hydrophobicized particulars includes one or more types of inorganic particulars of 20 nm or below in average and one or more types of inorganic particulars of 30 nm or over in average. The specific surface area measured by the BET method is preferably 20 m2/g to 500 m2/g.

Any known auxiliary additives are usable provided that they meet the conditions. Examples include silica particulate, hydrophobic silica, fatty acid metal salt (zinc stearate, aluminum stearate, and the like), metal oxide (titania, alumina, stannic oxide, antimony oxide, and the like), fluoropolymer, and the like.

Particularly preferable auxiliary additives include hydrophobicized silica, titania, titanium oxide, alumina. Included as the silica particulate are HDT H 2000, HDK H 2000/4, HDK H 2050EP, HVK21, HDK H1303 (available from Hoechst), R972, R974, RX200, RY200, R202, R805, R812 (available from Nippon Aerosil Co., Ltd.). Examples of the titania particulate include P-25 (available from Nippon Aerosil Co., Ltd.), STT-30, STT-65C-S (Available from Titan Kogyo Kabushiki Kaisha), TAF-140 (available from Fuji Titanium Industry), MT-150W, MT-500B, MT-600B, MT-150A (available from Tayca Corporation), and the like. Particular examples of the hydrophobicized titanium particulate include T-805 (available from Nippon Aerosil Co., Ltd.), STT-30A, STT-65S-S (available from Titan Kogyo Kabushiki Kaisha), TAF-500T, TAF-1550T (available from Fuji Titanium Industry), MT-100S, MT-100T (available from Tayca Corporation), IT-S (available from Ishihara Sangyo Kaisha Ltd.), and the like.

The oxide particulate, silica particulate, titania particulate, and alumina particulate which are hydrophobicized can be obtained by treating hydrophilic particulates with silane coupling agents such as methyltrimethoxysilane, methyltriethoxysilane, octyltrimethoxysilane. If necessary, silicone oil treated oxide particulate which is obtained by treating silicone oil with heat into an inorganic particulate is preferable. Examples of silicone oil include dimethyl silicone oil, methyl phenyl silicone oil, chloro phenyl silicone oil, methyl hydrogen silicone oil, alkyl modified silicone oil, fluorine modified silicone oil, polyether modified silicone oil, alcohol modified silicone oil, amino modified silicone oil, epoxy modified silicone oil, epoxy polyether modified silicone oil, phenol modified silicone oil, carboxyl modified silicone oil, mercapto modified silicone oil, acryl, methacrylic modified silicone oil, α-methyl styrene modified silicone oil, and the like.

Specific examples of the inorganic particulates include silica, alumina, titanium oxide, barium titanate, magnesium titanate, calcium titanate, strontium titanate, iron oxide, copper oxide, zinc oxide, tin oxide, silica sand, clay, mica, silicic pyroclastic rock, diatomite, chromium oxide, cerium oxide, red iron oxide, antimony trioxide, magnesium oxide, zirconium oxide, barium sulfate, barium carbonate, calcium carbonate, silicon carbide, silicon nitride, and the like. Among the above, silica and titanium dioxide are particularly preferable. The adduct is 0.1 weight % to 5 weight %, preferably 0.3 weight % to 3 weight % to the toner. The primary particle diameter of the inorganic particulates is 100 nm or below in average, preferably 3 nm to 70 nm in average. Smaller than the above range may embed the inorganic particulates in the toner, disenabling effective function of the inorganic particulates, while larger than the above range may unevenly scratch the surface of the photoconductor.

In addition, the examples include polymer particulates obtained by, for example, soap-free emulsion polymerization, suspension polymerization, or dispersion polymerization, such as polystyrene, methacrylate, and acrylate copolymers, and the like; condensation polymers such as silicone, benzoguanamine, nylon, or the like; polymer particles of thermosetting resins; and the like.

These auxiliary additives can be surface-treated to increase hydrophobicity so that they can prevent loss of flowability and chargeability even under high humidity. Examples of suitable surface treatment agents include silane coupling agents, silylating agents, silane coupling agents having a fluorinated alkyl group, organic titanate coupling agents, aluminum coupling agents, silicone oil, modified silicone oil, and the like.

A cleanability improving agent that can help remove the developer remaining on a photoconductor or a primary transfer medium after transfer can be added to a toner. Examples of the cleaneability improving agent include fatty acid metal salts such as zinc stearate, calcium stearate, stearic acid, and the like; polymer particulates manufactured by soap-free emulsion polymerization or the like such as polymethylmethacrylate particulates, polystyrene particulates; and the like. The polymer particulates preferably have a relatively narrow particle size distribution, and a volume average particle diameter of 0.01 μm to 1 μm.

(Resin Particulates)

Resin particulates may be included in a toner of the present invention if needed. The resin particulates that are used preferably have a glass transition temperature (Tg) of 40° C. to 100° C. and a weight average molecular weight of 9,000 to 200,000. As mentioned earlier, if the glass transition temperature (Tg) is lower than 40° C. and/or the weight average molecular weight is less than 9,000, the preservability of the toner is degraded and therefore a blocking can occur during storage or in a developing unit. If the glass transition temperature (Tg) is higher than 100° C. and/or the weight average molecular weight is more than 200,000, the resin particulates inhibit adhesiveness to a sheet of paper to which the toner is fused and therefore the lower limit fusing temperature will be higher.

The residual rate of the resin particulates to toner particles is preferably 0.5% by weight to 5.0% by weight. If the residual rate of the resin particulates is less than 0.5% by weight, the preservability of the toner is degraded and therefore a blocking can occur during storage or in a developing unit. If the residual rate of the resin particulates is more than 5.0% by weight, the resin particulates inhibit wax from seeping out and reduce the releaseability effect of the wax, and consequently may cause offset. The residual rate of the resin particulates can be measured by an analysis in which a pyrolysis gas chromatograph mass spectrometer is used to analyze a substance derived only from the resin particulates and not from the toner particles and calculate the peak area thereof. For the detector, a mass spectrometer is preferable, but it is not limited thereto.

The resin particulates can be made of any resin, thermoplastic or thermosetting, as long as they are capable of forming an aqueous dispersion. Examples thereof include vinyl resins, polyurethane resins, epoxy resins, polyester resins, polyamide resins, polyimide resins, silicon resins, phenol resins, melamine resins, urea resins, aniline resins, ionomer resins, polycarbonate resins, and the like. Two or more of these resins may be used in combination for the resin particulates. Among these, from the standpoint of the capability of obtaining an aqueous dispersion of the fine spherical resin particulates, vinyl resins, polyurethane resins, epoxy resins, polyester resins, and combinations thereof are preferable.

Vinyl resins include homopolymers and copolymers of vinyl monomers such as styrene-(meth)acrylate resin, styrene-butadiene copolymer, (meth)acrylate-acrylate polymer, styrene-acrylonitrile copolymer, styrene-maleic acid anhydride copolymer, styrene-(meth)acrylate copolymer, and the like.

(Process for Manufacturing Toner)

[Process for Manufacturing Toner Binder]

The toner binder may be, for example, manufactured by the following process.

A polyol (1) and a polycarboxylic acid (2) are heated to 150° C. to 280° C. in the presence of an esterification catalyst known in the art such as a tetrabutoxy titanate, dibutyl tin oxide, or the like. Next, the water produced in the reaction is distilled off under reduced pressure if necessary, and a polyester that contains hydroxyl groups is thereby obtained. Thereafter, the polyisocyanate (3) is reacted with the polyester at 40° C. to 140° C. so as to obtain the prepolymer (A) that contains isocyanate groups.

A dry toner of the present invention may be manufactured by the following process, being understood that it naturally does not limit the process for manufacturing.

[Process for Manufacturing Toner in (Aqueous Phase)]

The water medium (aqueous phase) used in the present invention is used after the resin particulates are added. The aqueous phase may be water alone, or water mixed with a miscible solvent. Examples of such miscible solvents include alcohols (methanol, isopropanol, ethylene glycol, and the like), dimethylformamide, tetrahydrofuran, cellusolves (methyl cellusolve, and the like.), lower ketones (acetone, methyl ethyl ketone, and the like).

An organic solvent, from a standpoint that is removed afterward, is preferred to be volatile having boiling point below 150° C. for easy removal thereof. Examples of such organic solvent include toluene, xylene, benzene, carbon tetrachloride, methylene chloride, 1,2-dichloroethane, 1,1,2-trichloroethane, trichloroethylene, chloroform, monochloro benzene, dichloroethylidene, methyl acetate, ethyl acetate, methyl ethyl ketone, methyl isobutyl ketone, and the like.

The toner particles may be formed by reacting a dispersion of an organic solvent {in which a polyester prepolymer (A) having isocyanate groups is dissolved or dispersed} with amines (B) in the aqueous phase. One of the processes for stably forming the dispersion of the organic solvent {comprising the polyester prepolymer (A)} in an aqueous phase is to add components of toner materials including the polyester prepolymer (A) (dissolved or dispersed as described above) to the aqueous phase, and disperse it by shear force. The polyester prepolymer (A) and other toner compositions (hereafter, referred to as toner materials) such as a colorant, colorant masterbatch, release agent, charge control agent, unmodified polyester resin, and the like may be mixed when the dispersion is formed in the aqueous phase, but it is preferable to first mix the toner materials together, and then dissolve or disperse this mixture in the organic solvent, and thereafter disperse the organic solvent in the aqueous phase. Further, for the present invention, it is not necessary to mix other toner materials such as a colorant, release agent, charge control agent, and the like when the particles are formed in the aqueous phase, and they may be added after the particles have been formed. For example, after forming particles that do not contain a colorant, a colorant can be added by a dyeing method known in the art.

There is no particular limitation on the dispersion method which may employ any dispersion apparatus known in the art such as low speed shear, high speed shear, friction, high-pressure jet, ultrasound, or the like. To obtain dispersed particles having a diameter of 2 μm to 20 μm, the high speed shear is preferred. When a high speed shear dispersion apparatus is used, there is no particular limitation on the rotation speed, but it is typically 1,000 rpm to 30,000 rpm, and is preferably 5,000 rpm to 20,000 rpm. There is no particular limitation on the dispersion time, but in the case of a batch process, this is typically 0.1 minute to 5 minutes. The temperature at which a dispersion is prepared is typically 0° C. to 150° C. (under pressure), preferably 40° C. to 98° C. If a higher temperature is used, the viscosity of the dispersion (organic solvent) comprising the polyester prepolymer (A) is lower, and dispersing is easier, which is desirable.

The amount of the aqueous phase relative to 100 parts by weight of the toner composition comprising the polyester prepolymer (A) is typically 50 parts by weight to 2,000 parts by weight, and is preferably 100 parts by weight to 1,000 parts by weight. If it is less than 50 parts by weight, the dispersion state of the toner composition is poor, and thereby particles having the predetermined particle diameter are not obtained. If it is more than 2,000 parts by weight, it is not economical. A dispersion agent can also be added if necessary. The use of a dispersion agent makes the particle distribution narrow and stabilizes the dispersion, and is therefore preferable.

Examples of dispersion agents which can be used to emulsify and disperse the oil phase (in which the toner composition is dispersed) into an aqueous phase are anionic surfactants such as alkyl benzene sulfonates, α-olefin sulfonates, phosphoric acid esters, or the like; amine salts such as alkylamine salts, aminoalcohol fatty acid derivatives, polyamine fatty acid derivatives, imidazoline, or the like; quaternary ammonium salt cationic surfactants such as alkyltrimethyl ammonium salts, dialkyl dimethyl ammonium salts, alkyl dimethyl benzyl ammonium salts, pyridinium salts, alkyl isoquinolinium salts, benzetonium chloride, or the like; non-ionic surfactants such as fatty acid amide derivatives, polyvalent alcohol derivatives, or the like; amphoteric surfactants such as alanine, dodecyldi(aminoethyl)glycine, di(octylaminoethyl)glycine, N-alkyl-N,N-dimethylammoniumbetaine, or the like; and the like.

By using a surfactant having a fluoroalkyl group, an effect can be obtained with an extremely small amount of the surfactant. Examples of anionic surfactants having a fluoroalkyl group which can be conveniently used are fluoroalkyl carboxylic acids having 2 to 10 carbon atoms and metal salts thereof, disodium perfluorooctane sulfonylglutamate, sodium 3-[omega-fluoroalkyl (C6 to C11)oxy]-1-alkyl (C3 to C4)sulfonate, sodium 3-[omega-fluoroalkanoyl (C6 to C8)-N-ethylamino]-1-propane sulfonate, fluoroalkyl (C11 to C20) carboxylic acids and metal salts thereof, perfluoroalkyl carboxylic acids (C7 to C13) and metal salts thereof, perfluoroalkyl (C4 to C12) sulfonates and metal salts thereof, perfluorooctanesulfonic acid diethanolamide, N-propyl-N-(2-hydroxyethyl) perfluorooctane sulfonamide, perfluoroalkyl (C6 to C10) sulfonamide propyltrimethylammonium salt, perfluoroalkyl (C6 to C10)-N-ethylsulfonyl glycine salt, monoperfluoroalkyl (C6 to C16) ethyl phosphoric acid ester, and the like.

Examples of the commercial products are Surflon S-111, Surflon S-112, Surflon S-113 (available from Asahi Glass Co., Ltd.), Fluorad FC-93, Fluorad FC-95, Fluorad FC-98, and Fluorad FC-129 (available from Sumitomo 3M, Co., Ltd.), Unidyne DS-101 and Unidyne DS-102 (available from Daikin Industries, Ltd.), Megaface F-110, Megaface F-120, Megaface F-113, Megaface F-191, Megaface F-812, and Megaface F-833 (available from Dainippon Ink and Chemicals Incorporated), Eftop EF-102, Eftop EF-103, Eftop EF-104, Eftop EF-105, Eftop EF-112, Eftop EF-123A, Eftop EF-123B, Eftop EF-306A, Eftop EF-501, Eftop EF-201, and Eftop EF-204 (available from JEMCO Inc.), FTERGENT F-100 and FTERGENT F-150 (available from NEOS), and the like.

Examples of cationic surfactants are primary, secondary or tertiary amines having a fluoroalkyl group, quaternary ammonium salts of fatty acids such as perfluoroalkyl (C6 to C10) sulfonamide propyltrimethylammonium salt, or the like; benzalkonium salts, benzetonium chloride, pyridinium chloride and imidazolinium salts, examples of commercial products being Surflon S-121 (available from Asahi Glass Co., Ltd.), Fluorad FC-135 (available from Sumitomo 3M, Co., Ltd.). Unidyne DS-202 (available from Daikin Industries, Ltd.), Megaface F-150 and Megaface F-824 (available from Dainippon Ink and Chemicals Incorporated), Eftop EF-132 (available from JEMCO Inc.), FTERGENT F-300 (available from NEOS), and the like.

Inorganic compound dispersing agents insoluble in water such as tricalcium phosphate, calcium carbonate, titanium oxide, colloidal silica, hydroxyapatite, or the like can also be used.

The dispersion droplets may also be stabilized by a high polymer protecting colloid. Examples are acids such as acrylic acid, methacrylic acid, α-cyanoacrylic acid, α-cyanomethacrylic acid, itaconic acid, crotonic acid, fumaric acid, maleic acid, maleic anhydride, or the like; (meth) acrylic monomers which contain hydroxyl groups such as β-hydroxyethyl acrylic acid, β-hydroxyethyl methacrylic acid, β-hydroxypropyl acrylic acid, β-hydroxypropyl methacrylic acid, γ-hydroxypropyl acrylic acid, γ-hydroxypropyl methacrylic acid, 3-chloro-2-hydroxypropyl acrylic acid, 3-chloro-2-hydroxypropyl methacrylic acid, diethylene glycol monoacrylic acid ester, diethylene glycol monoacrylic acid ester, diethylene glycol monomethacrylic acid ester, glycerine monoacrylic acid ester, glycerine monomethacrylic acid ester, N-methylolacrylamide, N-methylolmethacrylamide, or the like; vinyl alcohol or ether of vinyl alcohol such as vinyl methyl ether, vinyl ethyl ether and vinyl propyl ether, esters of compounds containing a carboxylic group with vinyl alcohol such as vinyl acetate, vinyl propionate and vinyl butyrate, acrylamide, methacrylamide, diacetone acrylamide, methylol compounds thereof, or the like; acid chlorides such as acrylic acid chloride and methacrylic acid chloride, homopolymers and copolymers containing a nitrogen atom or its heterocyclic ring such as vinyl pyridine, vinyl pyrolidone, vinyl imidazole, ethyleneimine, or the like; polyoxyethylene compounds such as polyoxyethylene, polyoxypropylene, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester, or the like; celluloses such as methyl cellulose, hydoxyethyl cellulose, hydroxypropyl cellulose, or the like; and the like.

If a substance such as calcium phosphate which is soluble in acid or alkali is used as a dispersion stabilizer, the calcium phosphate is dissolved using acid such as hydrochloric acid, or the like, and calcium phosphate is then removed from the particles by rinsing with water. It may also be removed by enzymatic decomposition.

If a dispersing agent is used, the dispersing agent may be left on the surface of the toner. From the viewpoint of charging toner, it is preferred to remove the dispersing agent by washing after elongation and/or cross-linking reaction.

Reaction time for the elongation and/or cross-linking is selected according to the reactivity of the combination of the isocyanate group in the prepolymer (A) and the amine (B), and it is typically 10 minutes to 40 hours, and is preferably 2 hours to 24 hours. The reaction temperature is typically 0° C. to 150° C., and is preferably 40° C. to 98° C. A catalyst known in the art may also be used if required. Specific examples are dibutyl tin laurate, dioctyl tin laurate, and the like.

To remove the organic solvent from the obtained emulsified dispersion, the temperature of the whole system is gradually raised, and the organic solvent in the liquid droplets is completely removed by evaporation. Alternatively, the emulsified dispersion is sprayed into a dry atmosphere to completely remove the water-insoluble organic solvent in the liquid droplets and form toner particles, and aqueous dispersing agent can be removed at the same time by evaporation. The dry atmosphere into which the emulsified dispersion is sprayed is generally a heated gas such as air, nitrogen, carbon dioxide or combustion gas, typically the gas flow being heated to a temperature at or above the boiling point of the highest-boiling point solvent being used. The desired product quality can be obtained in a short time by using a spray dryer, belt dryer, rotary kiln, or the like. For removing the organic solvent, a rotary evaporator and the like blowing in the air can be used.

Thereafter, centrifugal separation is used for harsh separation, then the emulsified dispersion is cleaned in a washing tank, a hot air drier is used for repeated dryings, thereby the solvent is removed and dried and a toner base can be obtained.

In the above emulsification, so as to accelerate reaction of particle formation, stirring can allow the gas (including air and the like), the solvent and the like to enter more smoothly than leaving at rest.

After removing the solvent, adding a maturing may sufficiently elongate the toner, controlling hollow state in the toner particle, which is preferable. Preferably, the maturing is to be carried out at 30° C. to 55° C. (more preferably, 40° C. to 50° C.) for 5 hours to 36 hours (more preferably, 10 hours to 24 hours). Omitting the maturing may leave the inside of the toner particle not reacted partly. In this case, degassing (solvent, carbon dioxide, water, air, and the like) may proceed gradually in a long term storage, thereby a preferred resin setting film is not effected, leading to a difficulty in controlling the hollow state. The temperature lower than 30° C. may not cause a sufficient heat, and thereby the reaction may be less likely to proceed. The temperature over 55° C. may deform the resin or partly dissolve the resin, which is not preferable. With the maturing time below 5 hours, the reaction may be insufficient. With the maturing time over 36 hours, the reaction which is saturated may nullify the effect or the extra reaction may bring about increased lower limit fusing temperature and the like.

If the particle size distribution during emulsification dispersion is large, and washing or drying are performed while maintaining this particle size distribution, the particle size distribution can be adjusted to a desired particle size distribution by classification. The classification is performed by removing particles from the liquid using a cyclone, decanter, centrifugal separation, or the like. The classifying can naturally be performed after obtaining the dry powder. It is preferred from the viewpoint of efficiency to perform this in the liquid. The unnecessary toner particles, either too small or too large, can be recycled to the kneading to form new toner particles. In that case, the unnecessary toner particles, either too small or too large, may be wet.

It is preferred that the dispersing agent is removed from the obtained dispersion as much as possible, and this is preferably done at the same time as the classifying described above.

The obtained powder of the toners after drying may be mixed with other particles such as release agent, charge control agent, flowability enhancer, colorant particulates, and the like, and a mechanical impact may be given to the mixed powder so that the particles are fixed or fused on the surface to each other, which prevents separation of the particles from the surface of the obtained complex particles.

Specific methods for doing this include giving an impact to the mixture by high speed rotating blades, introducing the mixture into a high-speed gas flow to be accelerated so that the particles collide with each other or the complex particles are made to strike a suitable impact plate, and the like. The device used for this purpose may be an Angmill (available from Hosokawa Micron Corporation) or I-mill (available from Nippon Pneumatic Mfg. Co., Ltd.) that is modified to reduce the air pressure upon pulverizing, a Hybridization system (available from Nara Machine Laboratories), a Kryptron system (available from Kawasaki Heavy Industries), an automatic mortar, or the like.

Finally, mixing the auxiliary additive such as inorganic particulates and the like with the toner by means of a Henschel mixer (available from Mitsui Mining) and the like and then removing too large particles by an ultrasonic sieve and the like can obtain the final toner.

(Method of Observing Pores)

Hereinafter described are details about a method of observing pores. In terms of machining efficiency, the sample's thermal damage and the like, the method under the present invention may preferably use gallium ion for a focused ion beam (FIB and the like). As a pretreatment of the sample, a carbon paste is applied onto a supporting body such as copper mesh and the like and then the toner is applied (sprinkled). Then, Pt (platinum) is evaporated, conductivity is secured, and tungsten is used for fixing the toner onto the supporting body, thus forming a cross section of the toner. An ultra thin slice having a thickness of 100 nm to 300 nm is preferred for observing the toner's damage and dispersing state of the components. The cross section can be observed with a transmission electron microscope (TEM), scanning transmission electron microscope (STEM), and the like. For reducing the sample's damage caused by the ion beam the current at the final treatment of the machining is preferred to be several μA to several mA.

(Two-component Carrier)

If the toner of the present invention is used in a two-component developer, it may be used in combination with a magnetic carrier, and the blending ratio of the carrier and the toner in the developer is preferably 1 part by weight to 10 parts by weight of the toner, relative to 100 parts by weight of the carrier. The magnetic carrier may be any of those known in the art. Examples of the magnetic carrier include iron powder, ferrite powder, magnetite powder, a magnetic resin carrier, or the like, each of which having a particle diameter of approximately 20 μm 200 μm. For coating materials, examples include amino resins such as urea-formaldehyde resin, melamine resin, benzoguanamine resin, urea resin, polyamide resin, epoxy resin, and the like. Other examples are polyvinyl and polyvinylidene resins such as acrylic resins, polymethyl methacrylate resin, polyacrylonitrile resin, polyvinyl acetate resin, polyvinyl alcohol resin, polyvinyl butyral resin, polystyrene resins such as styrene-acryl copolymer resin, halogenated olefin resins such as polyvinyl chloride, polyester resins such as polyethylene terephthalate resin and polybutylene terephthalate resin, polycarbonate resins, polyethylene resins, polyvinyl fluoride resin, polyvinylidene fluoride resin, polytrifluoro ethylene resin, polyhexafluoropropylene resin, copolymers of vinylidene fluoride with acrylic monomers, copolymers of vinylidene fluoride with vinyl fluoride, fluoroterpolymers such as the terpolymer of tetrafluoroethylene, vinylidene fluoride and a non-fluoride monomer, silicone resins, and the like. An electroconducting powder or the like may also be contained in the coating material if necessary. Examples of electroconducting powders are metal powders, carbon black, titanium oxide, tin oxide, zinc oxide, and the like. These electroconducting powders preferably have an average particle diameter of 1 μm or less. If the average particle diameter is more than 1 μm, it is difficult to control electrical resistance.

The toner of the present invention may also be used as a single-component magnetic toner that does not use a carrier. The toner of the present invention may also be used as a non-magnetic toner.

(Intermediate Transfer Body)

An intermediate transfer body can be used for the image forming apparatus, under the present invention. An embodiment of the intermediate transfer body of a transfer system will be described. FIG. 1 is a schematic view of a configuration of a copier of the embodiment. Around a photoconductor drum (hereinafter referred to as photoconductor) 110 as an image carrier, a charging roller 120 as a charging unit, an exposing device 130, a cleaning unit 160 having a cleaning blade, a diselectrifying lamp 170 as a device to remove charge, a developing unit 140, and an intermediate transfer body 150 are arranged. The intermediate transfer body 150 is configured so that it is suspended by a plurality of suspension rollers 151, and moves in the direction of the arrow by driving means such as a motor (not shown) and the like in a manner of an endless belt. One or more of the suspension rollers 151 has an additional role as a transfer bias roller, which supplies a transfer bias to the intermediate transfer body 150, and a power supply (not shown) applies a desired transfer bias voltage to the suspension rollers 151. Additionally, a cleaning unit 190 having a cleaning blade for the intermediate transfer body 150 is also arranged. Further, a transfer roller 180 is positioned facing the intermediate transfer body 150 as transfer unit to transfer a developed image to a sheet of transfer paper S, which is the final transfer material. A power source (not shown) supplies a transfer bias voltage to the transfer roller 180. Moreover, a corona charger 152 as a charging unit is located by the intermediate transfer body 150.

The developing unit 140 comprises a developing belt 141 as a developer support, a black (hereinafter K) developing unit 145K, a yellow (hereinafter Y) developing unit 145Y, a magenta (hereinafter M) developing unit 145M, and a cyan (hereinafter C) developing unit 145C. In addition, the developing belt 141 is configured so that it is suspended by a plurality of belt rollers, and by driving means such as a motor or the like (not shown), is advanced to the direction of the arrow in a manner of an endless belt. The developing belt 141 moves at substantially the same speed as the photoconductor 110 at a section where the two contact each other.

Since the configurations of the developing units 145 are common, only the K developing unit 145K will be described, and for other developing units 145Y, 145M, and 145C, components that correspond to those in the K developing unit 145K are shown in the figure with the same reference numbers followed by a letter Y, M, and C, respectively, and their descriptions are omitted. The developing unit 145K comprises a developing tank 142K that contains a solution of developer including toner particles and carrier component, a scooping roller 143K that is positioned so that its lower portion is dipped in the liquid developer in the developing tank 142K, and a applying roller 144K that receives the developer scooped by the scooping roller 143K, makes a thin layer of the developer, and applies the developer to the developing belt 141. The applying roller 144K is electrically conductive, and a power source (not shown) applies a desired bias to the applying roller 144K.

Figure 2:
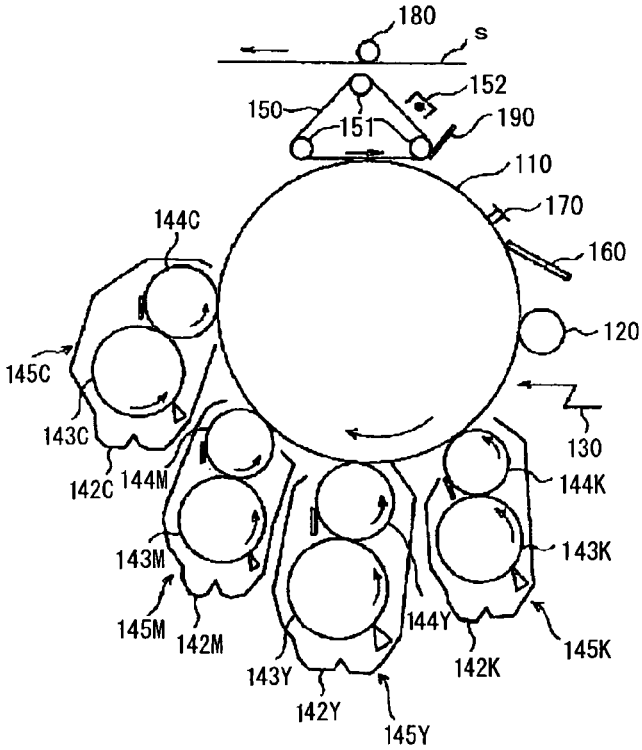
FIG. 2 is a schematic view of another example of an image forming method, according to an embodiment of the present invention.

With regards to the device configuration of the copier of this embodiment, a device configuration different from the one shown in FIG. 1 may be employed in which a developing unit 145 of each color is located around a photoconductor 110, as shown in FIG. 2.

Next, the operation of the copier of the embodiment will be described. In FIG. 1, the photoconductor 110 is rotationally driven in the direction of the arrow and is uniformly charged by the charging roller 120. Then, the exposing device 130 uses reflected light from the original document passing through an optical system (not shown) and forms by projection an electrostatic latent image on the photoconductor 110. The electrostatic latent image is then developed by the developing unit 140, and a toner image as a visualized (developed) image is formed. A thin layer of developer on the developing belt 141 is released from the developing belt 141 in a form of a thin layer by a contact with the photoconductor 110 in a developing region, and is moved to the portion where the latent image is formed on the photoconductor 110. The toner image developed by the developing unit 140 is transferred to the surface of the intermediate transfer body 150 at a portion of contact (primary transfer region) of the photoconductor 110 and the intermediate transfer body 150 that is moving at the same speed (primary transfer). In a case three colors or four colors are transferred and overlaid, the process is repeated for each color to form a color image on the intermediate transfer body 150.

The corona charger 152 is placed in order to charge the overlaid toner image on the intermediate transfer body 150, at a position that is downstream of the contact section of the photoconductor 110 and the intermediate transfer body 150, and that is upstream of the contact section of the intermediate transfer body 150 and the sheet of transfer paper S with regards to the direction of the rotation of the intermediate transfer body 150. Then, the corona charger 152 provides a true charge to the toner image the polarity of which is the same as that of the toner particles that form the toner image, and gives a sufficient charge for a good transfer to the sheet of transfer paper S. After being charged by the corona charger 152, the toner image is transferred at once to the sheet of transfer paper S that is carried in the direction of the arrow from a sheet feeder (not shown) by a transfer bias of the transfer roller 180 (secondary transfer). Thereafter, the sheet of transfer paper S to which the toner image is transferred is detached from the photoconductor 110 by a detaching device (not shown), and fusing is conducted thereto by a fusing device (not shown). After that, the sheet of transfer paper S is ejected from the device. On the other hand, after the transfer, the cleaning unit 160 removes and retrieves toner particles that are not transferred from the photoconductor 110, and the diselectrifying lamp 170 removes remaining charge from the photoconductor 110 to prepare for the next charging.

The static friction coefficient of the intermediate transfer body is preferably 0.1 to 0.6, more preferably 0.3 to 0.5. The volume resistance of the intermediate transfer body is preferably several Ωcm or more and 103 Ωcm or less. By controlling the volume resistance from several Ωcm to 103 Ωcm, charging of the intermediate transfer body itself is prevented. It also prevents uneven transfer at secondary transfer because the charge that is provided by charging unit does not remain as much on the intermediate transfer body. In addition, it is easier to apply transfer bias for the secondary transfer.

The materials for the intermediate transfer body is not particularly limited, and all materials known in the art can be used. Examples are named hereinafter. (1) Materials with high Young's modulus (tension elasticity) used as a single layer belt, which include polycarbonates (PC), polyvinylidene fluoride (PVDF), polyalkylene terephthalate (PAT), blend materials of PC/PAT, ethylene tetrafluoroethylene copolymer (ETFE)/PC, and ETFE/PAT, thermosetting polyimides of carbon black dispersion, and the like. These single layer belts having high Young's modulus are small in their deformation against stress during image formation and are particularly advantageous in that mis-registration is not easily formed when forming a color image. (2) A double or triple layer belt using the above-described belt having high Young's modulus as a base layer, added with a surface layer or an optional intermediate layer around the peripheral side of the base layer. The double or triple layer belt has a capability to prevent print defect of unclear center portion in a line image that is caused by the hardness of the single layer belt. (3) A belt with a relatively low Young's modulus that incorporates a rubber or an elastomer. This belt has an advantage that there is almost no print defect of unclear center portion in a line image due to its softness. Additionally, by making the width of the belt wider than driving and tension rollers and thereby using the elasticity of the edge portions that extend over the rollers, it can prevent snaky move of the belt. Therefore, it can reduce cost without the need for ribs and a device to prevent the snaky move.

Conventionally, intermediate transfer belts have been adopting fluorine resins, polycarbonate resins, polyimide resins, and the like, but in the recent years, elastic belts in which elastic members are used in all layers or a part thereof. There are issues on transfer of color images using a resin belt as described below.

Color images are typically formed by four colors of color toners. In one color image, toner layers of layer 1 to layer 4 are formed. Toner layers are pressurized as they pass the primary transfer (in which the toner layers are transferred from the photoconductor to the intermediate transfer belt) and the secondary transfer (in which the toner layers are transferred from the intermediate transfer belt to the sheet), which increases the cohesive force among toner particles. As the cohesive force increases, phenomena such as dropouts of letters and dropouts of edges of solid images are likely to occur. Since resin belts are too hard to be deformed by the toner layers, they tend to compress the toner layers and therefore dropout phenomena of letters are likely to occur.

Recently, the demand for printing full color images on various types of paper such as Japanese paper and paper having a rough (irregular) surface is increasing. However, with sheets of paper having low smoothness, gaps between the toner and the sheet are likely to be formed at transfer and therefore mis-transfers can happen. If the transfer pressure of the secondary transfer section is raised in order to increase contact, the cohesive force of the toner layers will be higher, which will result in dropout of letters as described above.

Elastic belts are used for the following aim. Elastic belts deform according to the toner layers and the roughness (irregularity) of the sheet having low smoothness at the transfer section. In other words, since the elastic belts deform to comply with local bumps and holes, a good contact is achieved without increasing the transfer pressure against the toner layers excessively so that it is possible to obtain transferred images having excellent uniformity without any dropout of letters even on sheets of paper of low flatness.

For the resin of the elastic belts, one or more can be selected from the group including polycarbonates, fluorine resins (ETFE, PVDF), styrene resins (homopolymers and copolymers including styrene or substituted styrene) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymers (styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymers (styrene-methyl methacrylate copolymer, styrene-ethyl methacrylate copolymer, styrene-phenyl methacrylate copolymer, and the like), styrene-α-chloromethyl acrylate copolymer, styrene-acrylonitrile acrylate copolymer, and the like, methyl methacrylate resin, butyl methacrylate resin, ethyl acrylate resin, butyl acrylate resin, modified acrylic resins (silicone-modified acrylic resin, vinyl chloride resin-modified acrylic resin, acrylic urethane resin, and the like), vinyl chloride resin, styrene-vinyl acetate copolymer, vinyl chloride-vinyl acetate copolymer, rosin-modified maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethylacrylate copolymer, xylene resin and polyvinylbutylal resin, polyamide resin, modified polyphenylene oxide resin, and the like. However, it is understood that the materials are not limited to those mentioned above.

For the rubber and elastomer of the elastic materials, one or more can be selected from the group including butyl rubber, fluorine rubber, acrylic rubber, ethylene propylene rubber (EPDM), acrylonitrilebutadiene rubber (NBR), acrylonitrile-butadiene-styrene natural rubber, isoprene rubber, styrene-butadiene rubber, butadiene rubber, ethylene-propylene rubber, ethylene-propylene terpolymer, chloroprene rubber, chlorosufonated polyethylene, chlorinated polyethylene, urethane rubber, syndiotactic 1,2-polybutadiene, epichlorohydrin rubber, silicone rubber, fluorine rubber, polysulfurized rubber, polynorbornen rubber, hydrogenated nitrile rubber, thermoplastic elastomers (such as polystyrene elastomers, polyolefin elastomers, polyvinyl chloride elastomers, polyurethane elastomers, polyamide elastomers, polyurea elastomers, polyester elastomers, and fluorine resin elastomers), and the like. However, it is understood that the materials are not limited to those mentioned above.

There are no limitations as to electric conductive agents for resistance adjustment, and examples include carbon black, graphite, metal powders such as aluminum, nickel, and the like; and electric conductive metal oxides such as tin oxide, titanium oxide, antimony oxide, indium oxide, potassium titanate, antimony tin oxide (ATO), indium tin oxide (ITO), and the like. The electric conductive metal oxides may be coated with non-conducting particulates such as barium sulfate, magnesium silicate, calcium carbonate, and the like. It is understood that the conductive agents are not limited to those mentioned above.

Materials of the surface layer is required to prevent contamination of the photoconductor by the elastic material and to reduce the surface friction of the transfer belt so that toner adhesion is lessened and the cleanability and secondary transfer property are increased. For example, one or more of polyurethane, polyester, epoxy resin, and the like is used, and powders or particles of a material that reduces surface energy and enhances lubrication such as fluorine resin, fluorine compound, carbon fluoride, titanium dioxide, silicon carbide, or the like can be dispersed and used. Hereinabove, one or more lubricant materials may be used or, alternatively, powders or particles of different sizes may be employed. In addition, it is possible to use a material such as fluorine rubber that is treated with heat so that a fluorine-rich layer is formed on the surface and the surface energy is reduced.

Several processes are listed below as examples of manufacturing processes of the belts, but the processes are not limited to these examples, and in general, two or more processes are combined for the manufacture of belts.

Centrifugal forming method in which material is poured into a rotating cylindrical mold to form a belt.

Spray application method in which a liquid paint is sprayed to form a film.

Dipping method in which a cylindrical mold is dipped into a solution of material and then pulled out.

Injection mold method in which material is injected between inner and outer mold.

A method in which a compound is applied onto a cylindrical mold and the compound is vulcanized and ground.

Methods to prevent elongation of the elastic belt include using a core resin layer that is difficult to elongate on which a rubber layer is formed, and incorporating into the core layer a material that prevents elongation, and the like, but the methods are not particularly related with the manufacturing processes.

For materials that prevent elongation and constitute a core layer, one or more can be selected from the group including, for example, natural fibers such as cotton, silk and the like; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers, and the like; inorganic fibers such as carbon fibers, glass fibers, boron fibers, and the like, metal fibers such as iron fibers, copper fibers, and the like, and materials in a form of a weave or thread can be used. It is understood naturally that the materials are not limited to those described above.

A thread may be one or more of filaments twisted together, and any twisting and plying is accepted such as single twisting, multiple twisting, doubled yarn, and the like. Further, fibers of different materials selected from the above-described group may be spun together. The thread may be treated before use in such a way that it is electrically conductive.

On the other hand, the weave may be of any type including plain knitting, and the like. It is naturally possible to use a union weave to apply electric conductive treatment.

The manufacturing process for the core layer is not particularly limited. For example, there is a method in which a weave that is woven in a cylindrical shape is placed on a mold or the like and a coating layer is formed on top of it. Another method uses a cylindrical weave being dipped in a liquid rubber or the like so that on one side or on both sides of the core layer, coating layer(s) is formed. In another example, a thread is wound helically to a mold or the like in an arbitrary pitch, and then a coating layer is formed thereon.

If the thickness of the elastic layer is too large, the elongation and contraction of the surface becomes large and may cause a crack on the surface layer although it depends on the hardness of the elastic layer. Moreover, if the amount of elongation and contraction is large, the size of images are elongated and contracted. Therefore, it is not preferred (about 1 mm or more).

(Tandem Color Image Forming Apparatus)

Figure 3:
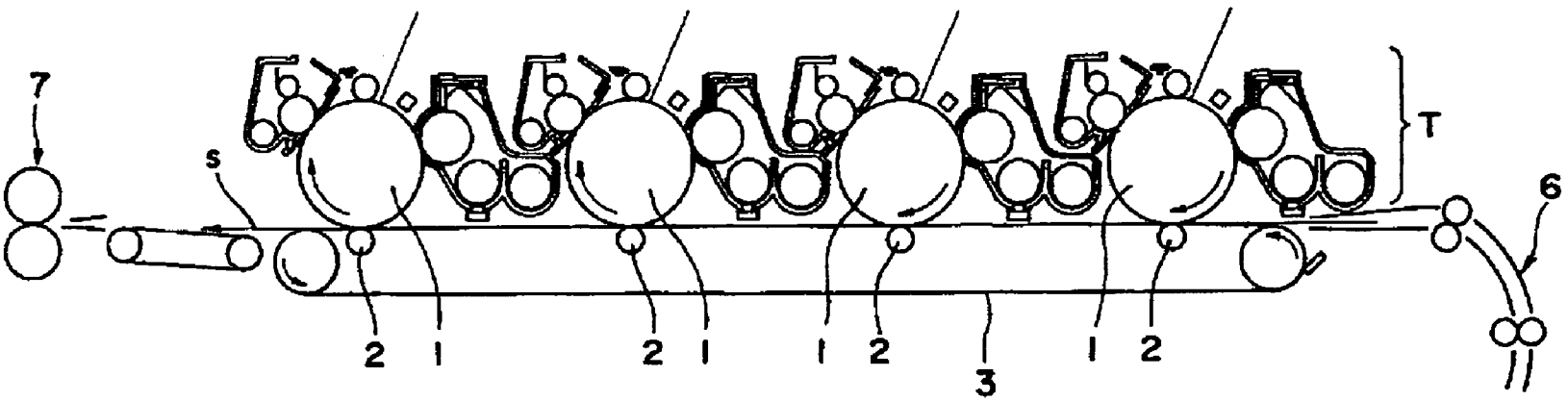
FIG. 3 is a schematic view of an example of a tandem-type image forming method, according to an embodiment.
Figure 4:
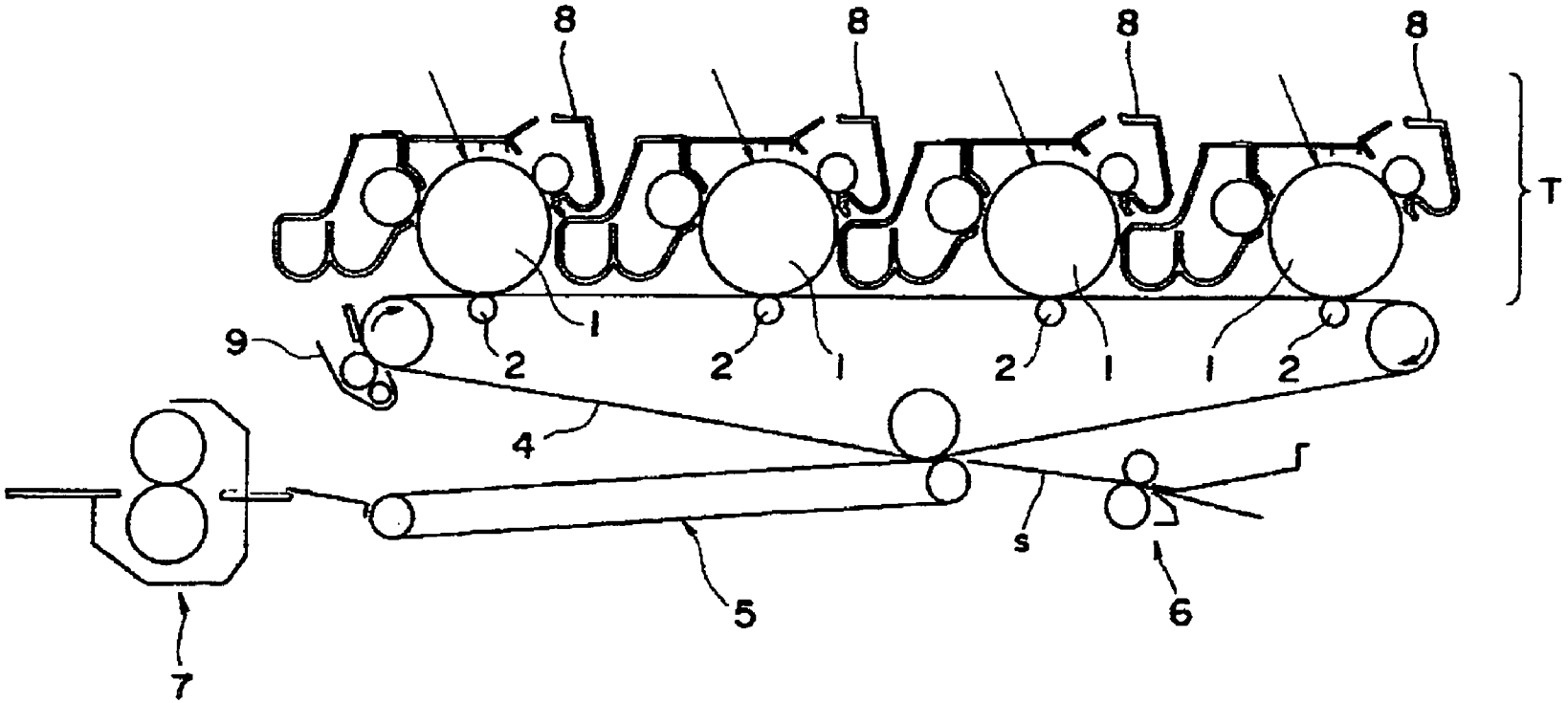
FIG. 4 is a schematic view of another example of a tandem-type image forming method, according to an embodiment.

The present invention can also be used as a tandem color image forming apparatus. An embodiment of the tandem color image forming apparatus will be described. There are two types of tandem electrophotographic apparatus. One is a direct transfer type as shown in FIG. 3 in which images on each photoconductor 1 are transferred in sequence by transfer units 2 to a sheet S that is carried by a sheet carrying belt 3. The other is an indirect transfer type as shown in FIG. 4 in which images on each photoconductor 1 are initially transferred in sequence by primary transfer units 2 to an intermediate transfer body 4 and then the image on the intermediate transfer body 4 is transferred by a secondary transfer unit 5 to a sheet S at once. The secondary transfer unit 5 here is a transfer carrying belt, but a roller can also be used.

When the direct transfer apparatus (FIG. 3) and the indirect transfer apparatus (FIG. 4) are compared, the former is disadvantageous in that it has to place a sheet feeder 6 in the upstream of a tandem image forming apparatus T (having the arranged photoconductors 1) and a fusing device 7 at the downstream and therefore its size becomes large in the direction of the sheet being carried.

In contrast, the latter can place the secondary transfer unit 5 relatively freely. It is advantageous in that the sheet feeder 6 and the fusing device 7 can be located under the tandem image forming apparatus T so that it can be made smaller.

Moreover, if one attempts to reduce the size increase in the direction of the sheet carriage with the direct transfer apparatus (FIG. 3), the fusing device 7 is to be positioned close to the tandem image forming apparatus T. Therefore, the fusing device 7 cannot be placed to provide the sheet S with enough space to bend and thus it is disadvantageous in that the fusing device 7 is likely to affect image formation in the upstream by the impact to the sheet S as the front edge of the sheet S enters the fusing device 7 (particularly obvious for a thick sheet) or by the difference in speed between sheet carrying speed while passing the fusing device 7 and that of the transfer carrying belt.

On the other hand, in the indirect transfer apparatus (FIG. 4), it is possible to position the fusing device 7 where sufficient space is available for the sheet S to bend, and therefore it can be designed so that the fusing device 7 has almost no effect on the image formation.

For such reasons, the tandem electrophotographic apparatuses, especially the indirect transfer type apparatuses, are recently gaining attention.

As shown in FIG. 4, in this type of color electrophotographic apparatuses, photoconductor cleaning units 8 remove residual toner that is remaining on the photoconductors 1 after the primary transfer and clean the surface of the photoconductors 1 to prepare for the next image formation. Additionally, an intermediate transfer body cleaning unit 9 removes residual toner that is remaining on the intermediate transfer body 4 after the secondary transfer and clean the surface of the intermediate transfer body 4 to prepare for the repeated image formation.

An embodiment of the present invention will be described with reference to figures hereinafter.

Figure 5:
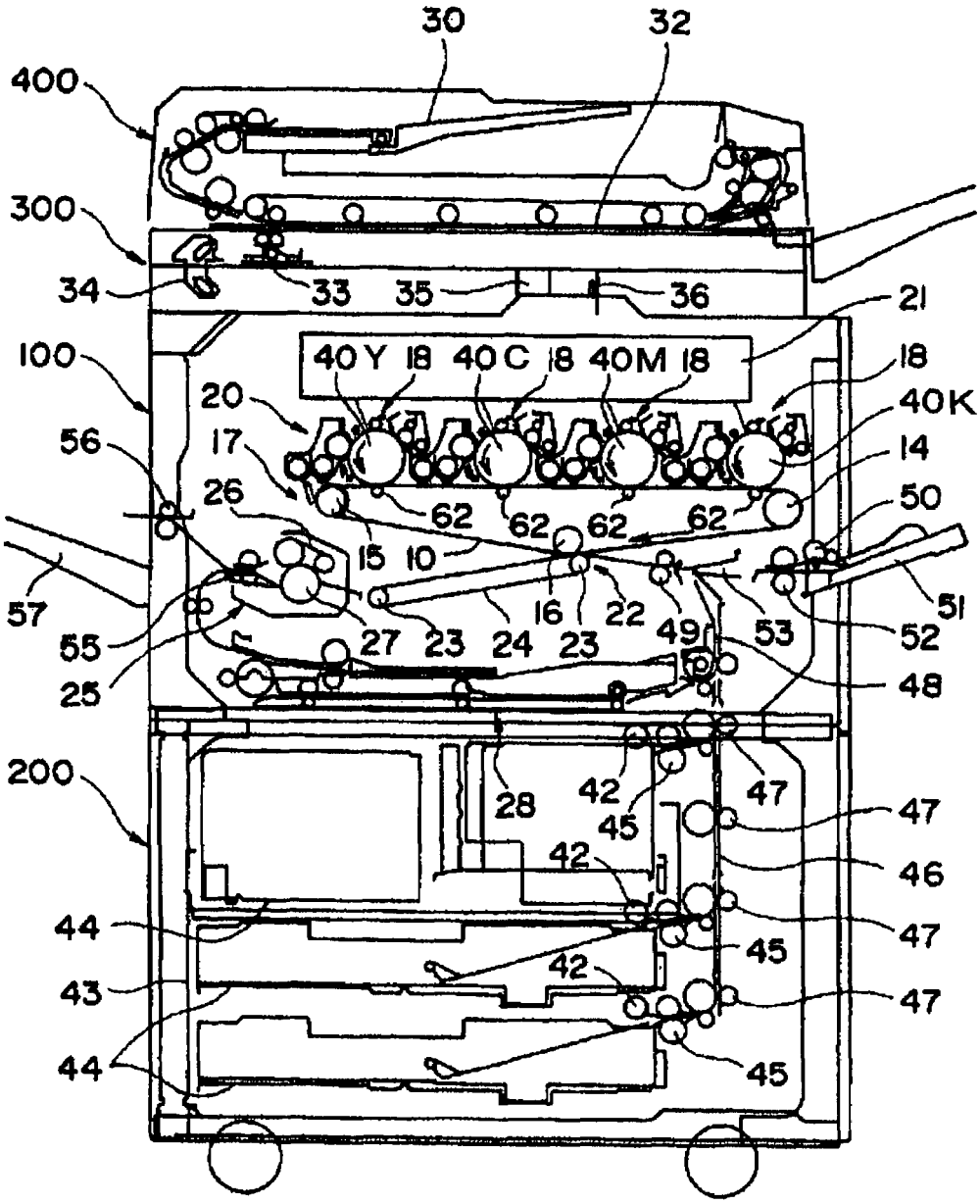
FIG. 5 is a schematic view of an example of an image forming method which is a tandem-type indirect transfer method.

FIG. 5 shows an embodiment of the present invention, which is an indirect transfer tandem electrophotographic apparatus. The reference number 100 represents a main body of copier apparatus, 200 a sheet feeder table for carrying thereon the main body 100, 300 a scanner that is mounted on the main body 100, and 400 an automatic document feeder (ADF) that is mounted on top of the scanner 300. The main body 100 has, in the middle, an intermediate transfer body 10, which is an endless belt.

In this embodiment as shown in FIG. 5, the intermediate transfer body 10 is suspended about three supporting rollers 14, 15, and 16, and is capable of rotating clockwise in FIG. 5.

In FIG. 5, an intermediate transfer body cleaning unit 17 that removes toner remaining on the intermediate transfer body 10 after image transfer is located to the left of the second of the three supporting rollers 15.

In addition, over the section of the intermediate transfer body 10 that extends between the first supporting roller 14 and the second supporting roller 15, four image forming units 18, yellow, cyan, magenta, and black are horizontally arranged in this order in the direction of the carriage so as to configure a tandem image forming apparatus 20.

Over the tandem image forming apparatus 20, as shown in FIG. 5, an exposing device 21 is placed. On the other hand, at the opposite side of the intermediate transfer body 10 from the tandem image forming apparatus 20, a secondary transfer unit 22 is located. The secondary transfer unit 22 has, in FIG. 5, a secondary transfer belt 24, which is an endless belt, extended between two rollers 23, and is located so that it is being pressed against the third supporting roller 16 through the intermediate transfer body 10 and therefore an image on the intermediate transfer body 10 can be transferred to a sheet.

A fusing device 25 that fuses a transferred image on a sheet is arranged beside the secondary transfer unit 22. The fusing device 25 includes a fusing belt 26, which is an endless belt, and a pressure roller 27 that is pressed against the fusing belt 26.

The secondary transfer unit 22 also has a sheet carrying function that carries a sheet after image transfer to this fusing device 25. Of course, a transfer roller or a non-contact charger may be located as the secondary transfer unit 22, but in such case it would be difficult for the secondary transfer unit 22 to have this sheet carrying function at the same time.

In this embodiment as shown in FIG. 5, a sheet reversing device 28 that flips a sheet upside down in order to record images on both sides of the sheet is located below the secondary transfer unit 22 and the fusing device 25 and parallel to the tandem image forming apparatus 20.

Now, in order to take a copy using this color electrophotographic apparatus, an original document is set on a document table 30 of the automatic document feeder 400. Or, alternatively, the automatic document feeder 400 may be opened to set the document on a contact glass 32 of the scanner 300 and closed thereafter, and use the automatic document feeder 400 to hold the document.

Then, by pressing a start switch (not shown), the scanner 300 is activated and a first moving body 33 and a second moving body 34 start moving after the document is carried onto the contact glass 32 if the document is set in the automatic document feeder 400, or, immediately after the start switch is pressed if the document is placed on the contact glass 32. Thereafter, a light is irradiated from a light source in the first moving body 33, and the light reflected from the document is once again reflected at the first moving body 33 toward the second moving body 34. Mirrors in the second moving body 34 reflect the light toward a reading sensor 36 through an imaging lens 35 and thus the content of the document is read.

By pressing the start switch (not shown), a drive motor (not shown) rotationally drives one of the supporting rollers 14, 15, and 16, and indirectly rotates two other supporting rollers 14, 15, and 16 so that the intermediate transfer body 10 is rotationally moved. At substantially the same time, at each image forming unit 18, its photoconductor 40 rotates, and the monochrome image of each of black, yellow, magenta, and cyan is formed on one of the photoconductors 40. Then, as the intermediate transfer body 10 moves, these monochrome images are successively transferred to form a composite color image on the intermediate transfer body 10.

Also, by pressing the start switch (not shown), one of sheet feeder rollers 42 of the sheet feeder table 200 is selected and driven so as to advance a sheet from one of sheet feeder cassettes 44 that are stacked vertically in a paper bank 43. The sheet is separated from other sheets one by one with a separating roller 45 and advanced to a sheet feeder path 46. Then, carrying rollers 47 carry the sheet to a sheet feeder guide 48 in the main body 100 where the sheet hits a resist roller 49 and is stopped.

Alternatively, a sheet feeder roller 50 is rotated to advance a sheet from a manual bypass tray 51. Then, a separating roller 52 separates the sheet from other sheets one by one and introduces the sheet to a manual bypass sheer feeder path 53 where the sheet hits a resist roller 49 and is stopped.

Then, the resist roller 49 rotates in accordance with the composite color image on the intermediate transfer body 10 and advances the sheet to between the intermediate transfer body 10 and the secondary transfer unit 22 where the secondary transfer unit 22 transfers onto the sheet to record the color image.

After the image transfer, the secondary transfer unit 22 carries the sheet to the fusing device 25 where the fusing device 25 applies heat and pressure to fuse the transferred image. Thereafter, a switching flap 55 switches so that the sheet is ejected by an ejecting roller 56 to be stacked on a paper output tray 57. Or alternatively, the switching flap 55 switches so that the sheet enters the sheet reversing device 28 where the sheet is reversed and advanced once again to transfer section. Then, an image is recorded on the reverse side of the sheet and thereafter the ejecting roller 56 ejects the sheet to the paper output tray 57.

After the image transfer, the intermediate transfer body cleaning unit 17 removes residual toner remaining on the intermediate transfer body 10 so that the intermediate transfer body 10 is ready for the next image forming by the tandem image forming apparatus 20.

The resist roller 49 is generally grounded in many cases, but a bias may be applied in order to remove paper dust on a sheet.

Figure 6:
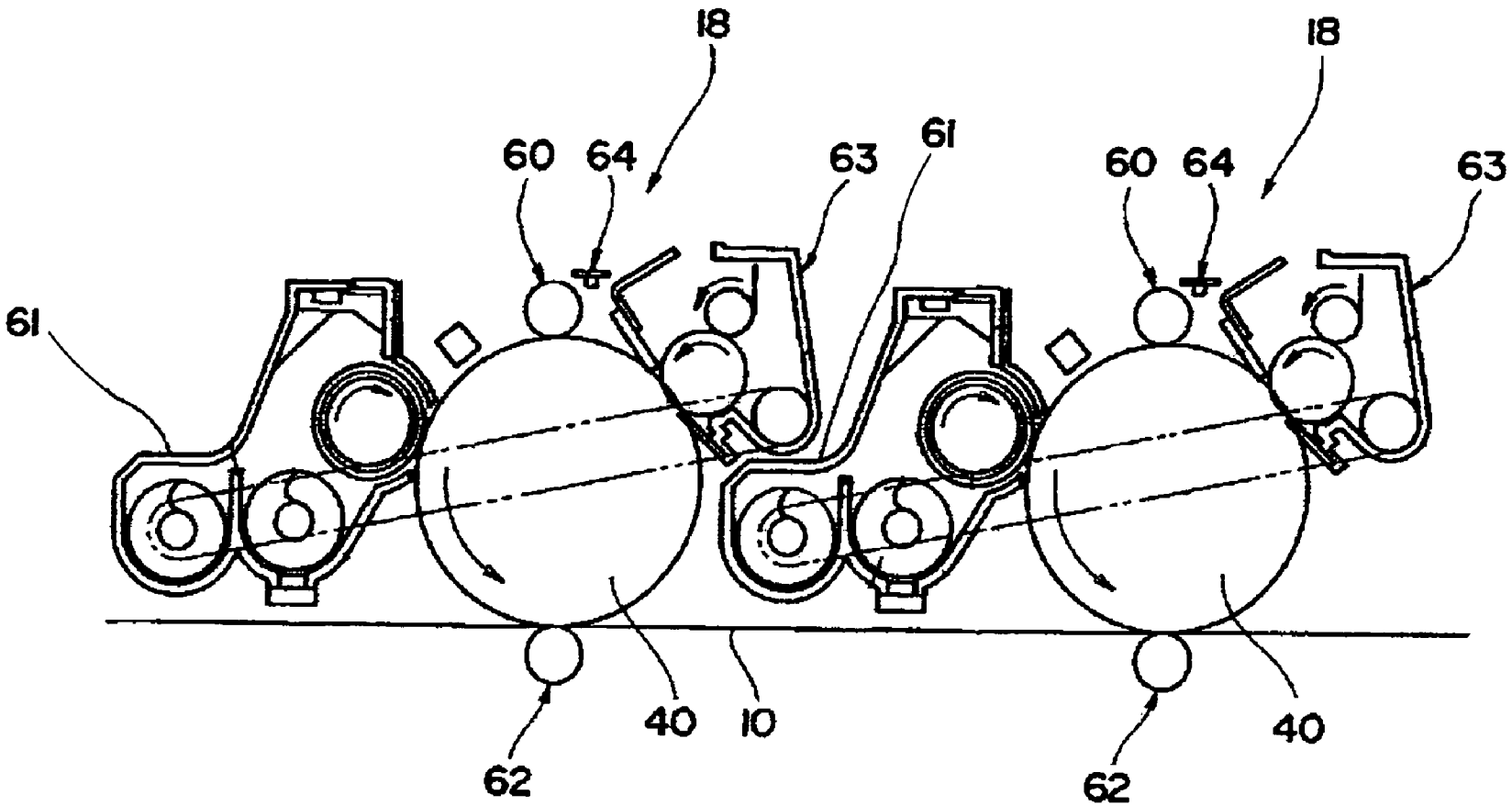
FIG. 6 is a partially enlarged view of an image forming apparatus in FIG. 5.

Each image forming unit 18 in the tandem image forming apparatus 20, as is shown in FIG. 6 with more detail, comprises, for example, a charging unit 60, developing unit 61, a primary transfer unit 62 (also shown in FIG. 5), a photoconductor cleaning unit 63, a charge removing device 64, and the like located around a photoconductor 40 having the shape of a drum.

Under the present invention, as a process cartridge, the photoconductor (image carrier) is integrated with at least one of the developing unit, the charging unit, and the cleaning unit and the like, and the thus integrated process cartridge is adapted to be attached to and detached from the main body of the image forming apparatus. The developing unit can hold the toner under the present invention.

EXAMPLES

The present invention will be described in more detail referring to examples hereinafter. It should be understood that the examples do not limit the scope of the present invention. In the following examples, "part(s)" means part(s) by weight.

Example 1

Manufacture Example

Synthesis of Organic Particulate Emulsion

To a reaction vessel provided with a stirrer and a thermometer, 683 parts of water, 11 parts of the sodium salt of the sulfuric acid ester of methacrylic acid ethylene oxide adduct (ELEMINOL RS-30, Sanyo Chemical Industries, Ltd.), 166 parts of methacrylic acid, 110 parts of butyl acrylate, and 1 part of ammonium persulphate were introduced, and stirred at 3800 rpm for 30 minutes to give a white emulsion. This was heated, the temperature in the system was raised to 75° C. and the reaction was performed for 4 hours. Next, 30 parts of an aqueous solution of 1% ammonium persulphate was added, and the reaction mixture was matured at 75° C. for 6 hours to obtain an aqueous dispersion of a vinyl resin "particulate emulsion 1" (copolymer of methacrylic acid-butyl acrylate-sodium salt of the sulfuric acid ester of methacrylic acid ethylene oxide adduct). The volume average particle diameter of "particulate emulsion 1" measured by LA-920 (laser diffraction/scattering type particle distribution measuring device and available from Horiba) was 110 nm. After drying part of "particulate emulsion 1" and isolating the resin, the glass transition temperature Tg of the resin was 58° C. and the volume average molecular weight was 130,000.

Manufacture Example 2

Preparation of Aqueous Phase

To 990 parts of water, 83 parts of "particulate emulsion 1," 37 parts of a 48.3% aqueous solution of sodium dodecyl diphenylether disulfonic acid (ELEMINOL MON-7: Sanyo Chemical Industries, Ltd.) and 90 parts of ethyl acetate were mixed and stirred together to obtain a milky liquid. This was taken as "aqueous phase 1."

Manufacture Example 3

Synthesis of Low Molecular Weight Polyester

In a reaction vessel equipped with a condenser, a stirrer, and a nitrogen inlet tube, 229 parts of bisphenol A ethylene oxide dimolar adduct, 529 parts of bisphenol A propylene oxide trimolar adduct, 208 parts of terephthalic acid, 46 parts of adipic acid and 2 parts of dibutyl tin oxide were placed, and the reaction was performed under a normal pressure at 230° C. for 7 hours, and under a reduced pressure of 10 mmHg to 15 mmHg for 5 hours, then 44 parts of anhydrous trimellitic acid was introduced into the reaction vessel, and the reaction was performed at 180° C. under the normal pressure for 3 hours to obtain "low molecular weight polyester 1." The "low molecular weight polyester 1" had a number average molecular weight of 2,300, weight average molecular weight of 6,700, glass transition temperature Tg of 43° C. and acid value of 25.

Manufacture Example 4

Synthesis of Intermediate Polyester

In a reaction vessel equipped with a condenser, a stirrer, and a nitrogen inlet tube, 682 parts of bisphenol A ethylene oxide dimolar adduct, 81 parts of bisphenol A propylene oxide dimolar adduct, 283 parts of terephthalic acid, 22 parts of anhydrous trimellitic acid and 2 parts of dibutyl tin oxide were placed, and the reaction was performed under a normal pressure at 230° C. for 7 hours, and then under a reduced pressure of 10 mmHg to 15 mmHg for 5 hours to obtain "intermediate polyester 1." The "intermediate polyester 1" had a number average molecular weight of 2,200, weight average molecular weight of 9,700, glass transition temperature Tg of 54° C., acid value of 0.5 and hydroxyl value of 52.

Next, 410 parts of "intermediate polyester 1," 89 parts of isohorone diisocyanate and 500 parts of ethyl acetate were placed in a reaction vessel equipped with a condenser, a stirrer, and a nitrogen inlet tube, and the reaction was performed at 100° C. for 5 hours to obtain "prepolymer 1." The free isocyanate % by weight of "prepolymer 1" was 1.53%.

Manufacture Example 5

Synthesis of Ketimine

Into a reaction vessel equipped with a stirrer and a thermometer, 170 parts of isohorone diamine and 75 parts of methyl ethyl ketone were introduced, and the reaction was performed at 50° C. for 4 and a half hours to obtain "ketimine compound 1." The amine value of "ketimine compound 1" was 417.

Manufacture Example 6

Synthesis of Masterbatch (MB)

To 1200 parts of water, 540 parts of carbon black (Printex 35, Degussa AG) [DBP oil absorption amount=42 ml/100 mg, pH=9.5] and 1200 parts of polyester resin were added and mixed in a Henschel mixer (available from Mitsui Mining), then the mixture was kneaded at 110° C. for 1 hour using two rollers, extrusion-cooled and crushed with a pulverizer to obtain "masterbatch 1."

Manufacture Example 7

Preparation of Oil Phase

Into a vessel equipped with a stirrer and a thermometer, 378 parts of "low molecular weight polyester 1," 100 parts of carnauba wax, and 947 parts of ethyl acetate were introduced, and the temperature was raised to 80° C. with stirring, maintained at 80° C. for 5 hours, and cooled to 30° C. in 1 hour. Next, 500 parts of "masterbatch 1" and 500 parts of ethyl acetate were introduced into the vessel, and mixed for 1 hour to obtain "initial material solution 1."

To a vessel, 1324 parts of "initial material solution 1" were transferred, and carbon black and wax were dispersed using a bead mill (ultra bead mill available from Imex) under the conditions of liquid feed rate of 1 kg/hr, disk circumferential speed of 6 m/sec, 0.5 mm zirconia beads packed to 80 volume % and 3 passes. Next, 1324 parts of a 65% ethyl acetate solution of "low molecular weight polyester 1" was added and the thus obtained was dispersed in 2 passes by the bead mill under the aforesaid conditions to obtain "pigment/wax dispersion 1." The solid concentration of "pigment/wax dispersion 1" (130° C., 30 minutes) was 50%.

Manufacture Example 8

Emulsification and Solvent Removal

In a vessel, 749 parts of "pigment/wax dispersion 1," 115 parts of "prepolymer 1" and 2.9 parts of "ketimine compound 1" were placed and mixed at 5,000 rpm for 2 minutes by a TK homomixer (available from Tokushu Kika Kogyo Co., Ltd.), then 1200 parts of "aqueous phase 1" were added to the vessel and mixed by the TK homomixer at a rotation speed of 13,000 rpm for 25 minutes to obtain "emulsion slurry 1."

"Emulsion slurry 1" was placed in a vessel equipped with a stirrer and a thermometer, then the solvent was removed at 30° C. for 8 hours and the product was matured at 45° C. for 24 hours to obtain "dispersion slurry 1."

Manufacture Example 9

Rinsing and Drying

After filtering 100 parts of "dispersion slurry 1" under reduced pressure, (1): 100 parts of ion-exchanged water were added to the filter cake, mixed by a TK homomixer (rotation speed 12,000 rpm for 10 minutes) and filtered.

(2): 100 parts of 10% sodium hydroxide aqueous solution were added to the filter cake of (1), mixed by a TK homomixer (rotation speed 12,000 rpm for 30 minutes) and filtered under reduced pressure.

(3): 100 parts of 10% hydrochloric acid were added to the filter cake of (2), mixed by a TK homomixer (rotation speed 12,000 rpm for 10 minutes) and filtered.

(4): 300 parts of ion-exchanged water were added to the filter cake of (3), mixed by a TK homomixer (rotation speed 12,000 rpm for 10 minutes), and filtered twice to obtain "filter cake 1."

"Filter cake 1" was dried in a circulating air dryer at 45° C. for 48 hours, and sieved through a 75 μm mesh to obtain "toner base particles 1." Then, 100 parts of the "toner base particles 1" and 1 part of hydrophobicized silica were mixed in a Henschel mixer to obtain toner.

Figure 7:
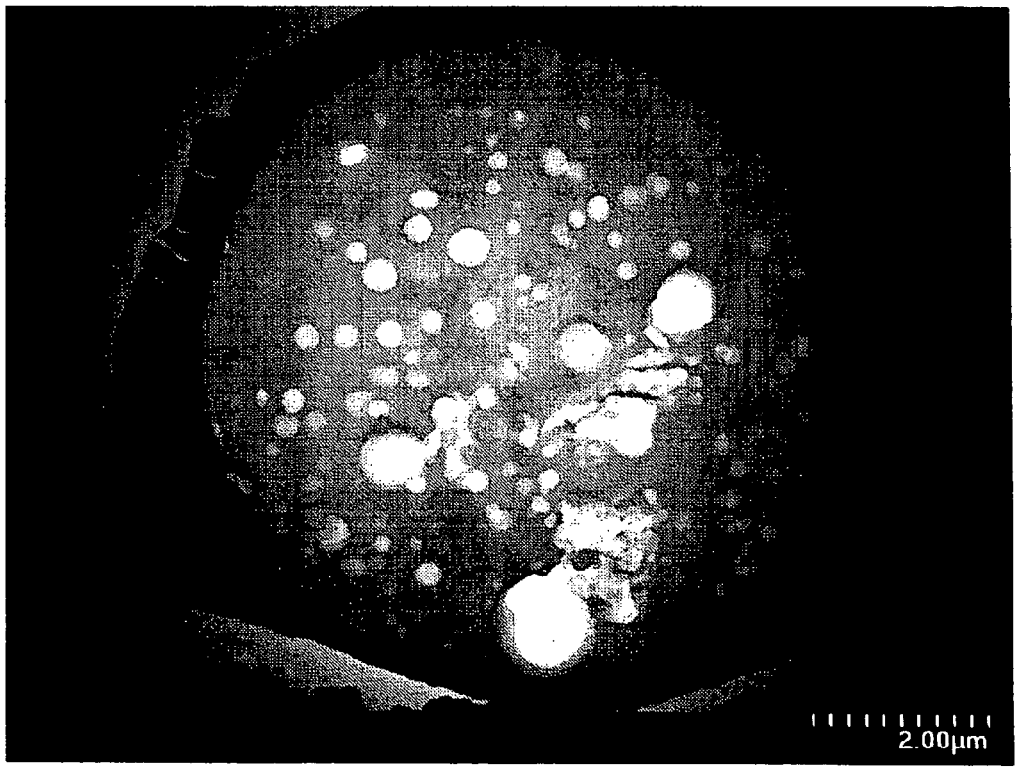
FIG. 7 is an STEM image of a cross section of toner particle obtained by an Example 1.

A cross section of the thus obtained toner particle was prepared by a pore observation method, and was observed with a scanning transmission electron microscope (STEM). A gallium ion was used for an ion beam, to form the above cross section having a thickness of 200 nm. FIG. 7 shows an image by the STEM. An apparent white circular is the pore. At least one pore was found to have a diameter of 10 nm or over.

In terms of the porosity, an image-processing software (Luzex, Image Plus Pro) calculated the pore area of the cross section relative to a total cross section. The thus obtained area ratio was defined as volume ratio. Five toner particles were used for making an average thereof The properties of the thus obtained toner are shown in Table 1, and evaluation results thereof are shown in Table 2.

Example 2

A toner is obtained in the same manner as that in Example 1 except that "pigment/wax dispersion 1" was changed to "pigment/wax dispersion 2" which was obtained by the following conditions for preparing the oil phase.

(Preparation of Oil Phase)

Into a vessel equipped with a stirrer and a thermometer, 378 parts of "low molecular weight polyester 1," 100 parts of carnauba/rice wax (weight ratio of carnauba to rice is 7 to 3), and 947 parts of ethyl acetate were introduced, and the temperature was raised to 80° C. with stirring, maintained at 80° C. for 4 hours, and cooled to 30° C. in 1 hour. Next, 500 parts of "masterbatch 1" and 500 parts of ethyl acetate were introduced into the vessel, and mixed for 1 hour to obtain "initial material solution 2."

To a vessel, 1324 parts of "initial material solution 2" were transferred, and carbon black and wax were dispersed using a bead mill (ultra bead mill available from Imex) under the conditions of liquid feed rate of 1 kg/hr, disk circumferential speed of 6 m/sec, 0.5 mm zirconia beads packed to 80 volume % and 7 passes. Next, 1324 parts of a 65% ethyl acetate solution of "low molecular weight polyester 1" was added and the thus obtained was dispersed in 4 passes by the bead mill under the aforesaid conditions to obtain "pigment/wax dispersion 2." The solid concentration of "pigment/wax dispersion 2" (130° C., 30 minutes) was 50%.

Like Example 1, a cross section of the thus obtained toner particle was prepared and observed. Like Example 1, at least one pore was found to have a diameter of 10 nm or over.

The properties of the thus obtained toner are shown in Table 1, and evaluation results thereof are shown in Table 2.

Example 3

A toner is obtained in the same manner as that in Example 1 except that the processes of emulsification and solvent removal were changed to have conditions as described below.

(Emulsification and Solvent Removal)

In a vessel, 749 parts of "pigment/wax dispersion 1," 115 parts of "prepolymer 1" and 2.9 parts of "ketimine compound 1" were placed and mixed at 5,000 rpm for 2 minutes by a TK homomixer (available from Tokushu Kika Kogyo Co., Ltd.), then 1200 parts of "aqueous phase 1" were added to the vessel and mixed by the TK homomixer at a rotation speed of 13,000 rpm for 10 minutes to obtain "emulsion slurry 3."

"Emulsion slurry 3" was placed in a vessel equipped with a stirrer and a thermometer, then the solvent was removed at 30° C. for 6 hours and the product was matured at 45° C. for 10 hours to obtain "dispersion slurry 3."

Like Example 1, a cross section of the thus obtained toner particle was prepared and observed. Like Example 1, at least one pore was found to have a diameter of 10 nm or over.

The properties of the thus obtained toner are shown in Table 1, and evaluation results thereof are shown in Table 2.

Example 4

A toner is obtained in the same manner as that in Example 1 except that the processes of emulsification and solvent removal were changed to have conditions as described below.

(Emulsification and Solvent Removal)

In a vessel, 749 parts of "pigment/wax dispersion 1," 115 parts of "prepolymer 1" and 2.9 parts of "ketimine compound 1" were placed and mixed at 5,000 rpm for 2 minutes by a TK homomixer (available from Tokushu Kika Kogyo Co., Ltd.), then 1200 parts of "aqueous phase 1" were added to the vessel and mixed by the TK homomixer at a rotation speed of 13,000 rpm for 40 minutes to obtain "emulsion slurry 4."

"Emulsion slurry 4" was placed in a vessel equipped with a stirrer and a thermometer, then the solvent was removed at 30° C. for 10 hours and the product was matured at 45° C. for 10 hours to obtain "dispersion slurry 4."

Like Example 1, a cross section of the thus obtained toner particle was prepared and observed. Like Example 1, at least one pore was found to have a diameter of 10 nm or over.

The properties of the thus obtained toner are shown in Table 1, and evaluation results thereof are shown in Table 2.

Example 5

A toner is obtained in the same manner as that in Example 1 except that the process for preparation of oil phase was changed to have conditions as described below.

(Preparation of Oil Phase)

Into a vessel equipped with a stirrer and a thermometer, 378 parts of "low molecular weight polyester 1," 130 parts of carnauba/rice wax (weight ratio of carnauba to rice is 7 to 3), and 947 parts of ethyl acetate were introduced, and the temperature was raised to 80° C. with stirring, maintained at 80° C. for 4 hours, and cooled to 30° C. in 1 hour. Next, 500 parts of "masterbatch 1" and 500 parts of ethyl acetate were introduced into the vessel, and mixed for 2 hours to obtain "initial material solution 3."

To a vessel, 1324 parts of "initial material solution 3" were transferred, and carbon black and wax were dispersed using a bead mill (ultra bead mill available from Imex) under the conditions of liquid feed rate of 1 kg/hr, disk circumferential speed of 6 m/sec, 0.5 mm zirconia beads packed to 80 volume % and 7 passes. Next, 1324 parts of a 65% ethyl acetate solution of "low molecular weight polyester 1" was added and the thus obtained was dispersed in 4 passes by the bead mill under the aforesaid conditions to obtain "pigment/wax dispersion 3." The solid concentration of "pigment/wax dispersion 3" (130° C., 30 minutes) was 50%.

Like Example 1, excluding the cross sectional thickness of 100 nm in Example 5, a cross section of the thus obtained toner particle was prepared and observed. Like Example 1, at least one pore was found to have a diameter of 10 nm or over.

The properties of the thus obtained toner are shown in Table 1, and evaluation results thereof are shown in Table 2.

Example 6

A toner is obtained in the same manner as that in Example 1 except that the process for preparation of oil phase was changed to have conditions as described below.

(Preparation of Oil Phase)

Into a vessel equipped with a stirrer and a thermometer, 378 parts of "low molecular weight polyester 1," 50 parts of carnauba/rice wax (weight ratio of carnauba to rice is 7 to 3), and 947 parts of ethyl acetate were introduced, and the temperature was raised to 80° C. with stirring, maintained at 80° C. for 4 hours, and cooled to 30° C. in 1 hour. Next, 500 parts of "masterbatch 1" and 500 parts of ethyl acetate were introduced into the vessel, and mixed for 0.8 hour to obtain "initial material solution 4."

To a vessel, 1324 parts of "initial material solution 4" were transferred, and carbon black and wax were dispersed using a bead mill (ultra bead mill available from Imex) under the conditions of liquid feed rate of 1 kg/hr, disk circumferential speed of 6 m/sec, 0.5 mm zirconia beads packed to 80 volume % and 5 passes. Next, 1324 parts of a 65% ethyl acetate solution of "low molecular weight polyester 1" was added and the thus obtained was dispersed in 3 passes by the bead mill under the aforesaid conditions to obtain "pigment/wax dispersion 4." The solid concentration of "pigment/wax dispersion 4" (130° C., 30 minutes) was 50%.

Like Example 5, a cross section of the thus obtained toner particle was prepared and observed. Like Example 1, at least one pore was found to have a diameter of 10 nm or over.

The properties of the thus obtained toner are shown in Table 1, and evaluation results thereof are shown in Table 2.

Example 7

A toner is obtained in the same manner as that in Example 1 except that the synthesis of low molecular weight polyester, the preparation of oil phase, the processes of emulsification and solvent removal were changed to have conditions as described below.

(Synthesis of Low Molecular Weight Polyester)

In a reaction vessel equipped with a condenser, a stirrer, and a nitrogen inlet tube, 229 parts of bisphenol A ethylene oxide dimolar adduct, 529 parts of bisphenol A propylene oxide trimolar adduct, 208 parts of terephthalic acid, 46 parts of adipic acid and 2 parts of dibutyl tin oxide were placed, and the reaction was performed under a normal pressure at 230° C. for 7 hours, and under a reduced pressure of 10 mmHg to 15 mmHg for 5 hours, then 44 parts of anhydrous trimellitic acid was introduced into the reaction vessel, and the reaction was performed at 180° C. under a normal pressure for 3 hours to obtain "low molecular weight polyester 2." The "low molecular weight polyester 2" had a number average molecular weight of 2,300, weight average molecular weight of 6,700, peak molecular weight of 3100, glass transition temperature Tg of 43° C. and acid value of 25.

(Preparation of Oil Phase)

Into a vessel equipped with a stirrer and a thermometer, 378 parts of "low molecular weight polyester 2," 100 parts of carnauba wax, and 947 parts of ethyl acetate were introduced, and the temperature was raised to 80° C. with stirring, maintained at 80° C. for 5 hours, and cooled to 30° C. in 1 hour. Next, 500 parts of "masterbatch 1" and 500 parts of ethyl acetate were introduced into the vessel, and mixed for 1 hour to obtain "initial material solution 5."

To a vessel, 1324 parts of "initial material solution 5" were transferred, and carbon black and wax were dispersed using a bead mill (ultra bead mill available from Imex) under the conditions of liquid feed rate of 1 kg/hr, disk circumferential speed of 6 m/sec, 0.5 mm zirconia beads packed to 80 volume % and 3 passes. Next, 1324 parts of a 65% ethyl acetate solution of "low molecular weight polyester 2" was added and dispersed in 2 passes by the bead mill under the aforesaid conditions to obtain "pigment/wax dispersion 5." The solid concentration of "pigment/wax dispersion 5" (130° C., 30 minutes) was 50%.

Emulsification and Solvent Removal

In a vessel, 749 parts of "pigment/wax dispersion 5," 115 parts of "prepolymer 1" and 2.9 parts of "ketimine compound 1" were placed and mixed at 5,000 rpm for 2 minutes by a TK homomixer (available from Tokushu Kika Kogyo Co., Ltd.), then 1200 parts of "aqueous phase 1" were added to the vessel and mixed by the TK homomixer at a rotation speed of 13,000 rpm for 40 minutes to obtain "emulsion slurry 7."

"Emulsion slurry 7" was placed in a vessel equipped with a stirrer and a thermometer, then the solvent was removed at 30° C. for 8 hours and the product was matured at 45° C. for 10 hours to obtain "dispersion slurry 7."

Like Example 5, a cross section of the thus obtained toner particle was prepared and observed. Like Example 1, at least one pore was found to have a diameter of 10 nm or over.

The properties of the thus obtained toner are shown in Table 1, and evaluation results thereof are shown in Table 2.

A toner is obtained in the same manner as that in Example 1 except that the preparation of oil phase was changed to have conditions as described below.

(Preparation of Oil Phase)

Into a vessel equipped with a stirrer and a thermometer, 378 parts of "low molecular weight polyester 1," 400 parts of carnauba wax, and 947 parts of ethyl acetate were introduced, and the temperature was raised to 80° C. with stirring, maintained at 80° C. for 4 hours, and cooled to 30° C. in 1 hour. Next, 500 parts of "masterbatch 1" and 500 parts of ethyl acetate were introduced into the vessel, and mixed for 2 hours to obtain "initial material solution 6."

To a vessel, 1324 parts of "initial material solution 6" were transferred, and carbon black and wax were dispersed using a bead mill (ultra bead mill available from Imex) under the conditions of liquid feed rate of 1 kg/hr, disk circumferential speed of 6 m/sec, 0.5 mm zirconia beads packed to 80 volume % and 7 passes. Next, 1324 parts of a 65% ethyl acetate solution of "low molecular weight polyester 1" was added and the thus obtained was dispersed in 4 passes by the bead mill under the aforesaid conditions to obtain "pigment/wax dispersion 6." The solid concentration of "pigment/wax dispersion 6" (130° C., 30 minutes) was 50%.

Like Example 5, a cross section of the thus obtained toner particle was prepared and observed. Like Example 1, at least one pore was found to have a diameter of 10 nm or over.

The properties of the thus obtained toner are shown in Table 1, and evaluation results thereof are shown in Table 2.

A toner is obtained in the same manner as that in Example 1 except that the processes of emulsification and solvent removal were changed to have conditions as described below.

(Emulsification and Solvent Removal)

In a vessel, 749 parts of "pigment/wax dispersion 1," 115 parts of "prepolymer 1" and 2.9 parts of "ketimine compound 1" were placed and mixed at 5,000 rpm for 2 minutes by a TK homomixer (available from Tokushu Kika Kogyo Co., Ltd.), then 1200 parts of "aqueous phase 1" were added to the vessel and mixed by the TK homomixer at a rotation speed of 13,000 rpm for 1 hour and 30 minutes to obtain "emulsion slurry 9."

"Emulsion slurry 9" was placed in a vessel equipped with a stirrer and a thermometer, then the solvent was removed at 30° C. for 8 hours and the product was matured at 45° C. for 10 hours to obtain "dispersion slurry 9."

Like Example 1, excluding the cross sectional thickness of 300 nm in Example 9, a cross section of the thus obtained toner particle was prepared and observed. Like Example 1, at least one pore was found to have a diameter of 10 nm or over.

The properties of the thus obtained toner are shown in Table 1, and evaluation results thereof are shown in Table 2.

A toner is obtained in the same manner as that in Example 1 except that the processes of emulsification and solvent removal were changed to have conditions as described below.

(Emulsification and Solvent Removal)

In a vessel, 749 parts of "pigment/wax dispersion 1," 115 parts of "prepolymer 1" and 2.9 parts of "ketimine compound 1" were placed, then 1200 parts of "aqueous phase 1" were added to the vessel and mixed by a TK homomixer (available from Tokushu Kika Kogyo Co., Ltd.) at a rotation speed of 13,000 rpm for 1 hour to obtain "emulsion slurry 10."

"Emulsion slurry 10" was placed in a vessel equipped with a stirrer and a thermometer, then the solvent was removed at 30° C. for 8 hours and the product was matured at 45° C. for 10 hours to obtain "dispersion slurry 10."

Like Example 9, a cross section of the thus obtained toner particle was prepared and observed. Like Example 1, at least one pore was found to have a diameter of 10 nm or over.

The properties of the thus obtained toner are shown in Table 1, and evaluation results thereof are shown in Table 2.

Comparative Example 1

A toner is obtained in the same manner as that in Example 1 except that the synthesis of low molecular weight polyester, the preparation of oil phase, the processes of emulsification and solvent removal were changed to have conditions as described below. The emulsification process is carried out in a still and housed state that can prevent gas (including air), solvent and the like from entering the particle and that can cause a slow reaction and is less likely to cause degassing.

(Synthesis of Low Molecular Weight Polyester)

In a reaction vessel equipped with a condenser, a stirrer, and a nitrogen inlet tube, 229 parts of bisphenol A ethylene oxide dimolar adduct, 529 parts of bisphenol A propylene oxide trimolar adduct, 208 parts of terephthalic acid, 46 parts of adipic acid and 2 parts of dibutyl tin oxide were placed, and the reaction was performed under a normal pressure at 230° C. for 7 hours, and under a reduced pressure of 10 mmHg to 15 mmHg for 5 hours, then 44 parts of anhydrous trimellitic acid was introduced into the reaction vessel, and the reaction was performed at 180° C. under a normal pressure for 3 hours to obtain "low molecular weight polyester 2." The "low molecular weight polyester 2" had a number average molecular weight of 2,300, weight average molecular weight of 6,700, peak molecular weight of 3100, glass transition temperature Tg of 43° C. and acid value of 25.

(Preparation of Oil Phase)

Into a vessel equipped with a stirrer and a thermometer, 378 parts of "low molecular weight polyester 2," 100 parts of carnauba wax, and 947 parts of ethyl acetate were introduced, and the temperature was raised to 80° C. with stirring, maintained at 80° C. for 5 hours, and cooled to 30° C. in 1 hour. Next, 500 parts of "masterbatch 1" and 500 parts of ethyl acetate were introduced into the vessel, and mixed for 1 hour to obtain "initial material solution 5."

To a vessel, 1324 parts of "initial material solution 5" were transferred, and carbon black and wax were dispersed using a bead mill (ultra bead mill available from Imex) under the conditions of liquid feed rate of 1 kg/hr, disk circumferential speed of 6 m/sec, 0.5 mm zirconia beads packed to 80 volume % and 3 passes. Next, 1324 parts of a 65% ethyl acetate solution of "low molecular weight polyester 2" was added and dispersed in 2 passes by the bead mill under the aforesaid conditions to obtain "pigment/wax dispersion 5." The solid concentration of "pigment/wax dispersion 5" (130° C., 30 minutes) was 50%.

Emulsification and Solvent Removal

In a vessel, 749 parts of "pigment/wax dispersion 5," 115 parts of "prepolymer 1" and 2.9 parts of "ketimine compound 1" were placed and mixed at 5,000 rpm for 2 minutes by a TK homomixer (available from Tokushu Kika Kogyo Co., Ltd.), then 1200 parts of "aqueous phase 1" were added to the vessel and the thus obtained was maintained at rest for 1 hour to obtain "emulsion slurry 11."

"Emulsion slurry 11" was placed in a vessel equipped with a stirrer and a thermometer, then the solvent was removed at 30° C. for 8 hours to obtain "dispersion slurry 11." The maturing was not carried out thereafter.

Figure 8:
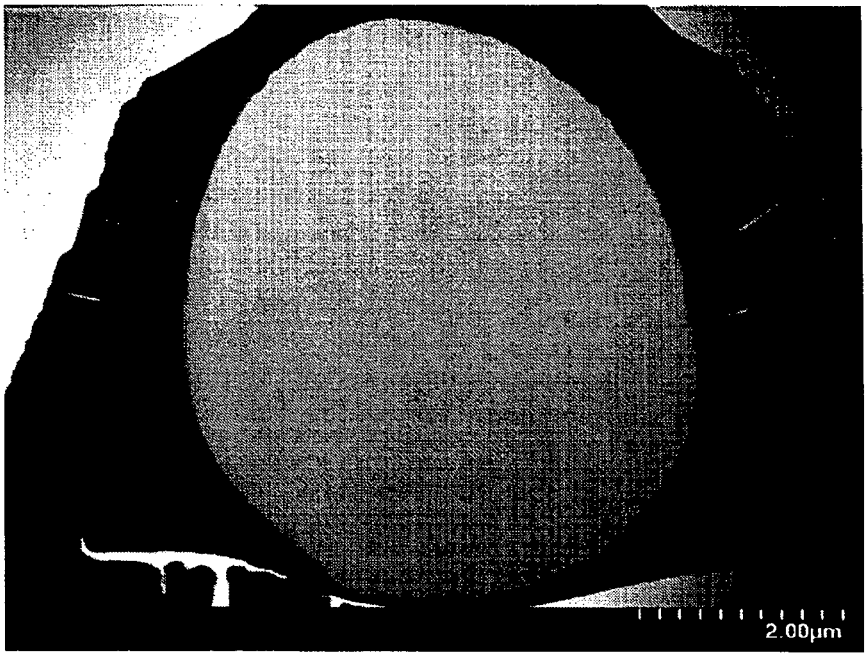
FIG. 8 is an STEM image of a cross section of toner particle obtained by a Comparative example 1.

FIG. 8 shows an STEM image of cross section of the toner particle which section is observed in the same manner as that of Example 1. FIG. 8 shows no pore in the toner particle.

The properties of the thus obtained toner are shown in Table 1, and evaluation results thereof are shown in Table 2.

Comparative Example 2

<First Step>

[Preparation of Dispersion (1)]

| | |
|---|---|
| Styrene: | 370 g |
| n-butylacrylate: | 30 g |
| Acrylic acid: | 8 g |
| Dodecanthiol: | 24 g |
| Carbon tetrabromide: | 4 g |

These materials were mixed and dissolved and were then added to a flask of 550 g of ion-exchanged water in which 6 g of nonionic surfactant (Nonipol 400 available from Sanyo Chemical Industries, Ltd.) and 10 g of anionic surfactant (Neogen SC available from Dai-ichi Kogyo Seiyaku Co., Ltd.) were dissolved. In the flask, the mixture was then dispersed, emulsified, and slowly mixed for 10 minutes while adding 50 g of ion-exchanged water in which 4 g of ammonium persulfate is dissolved. Nitrogen substitution is conducted, and the flask is heated in an oil bath with stirring until the mixture (content) is 70° C., and it was kept for 5 hours so that emulsion polymerization was allowed to continue. As a result, a dispersion (1) containing resin particulates having an average diameter of 155 nm, glass transition temperature of 59° C., and weight average molecular weight (Mw) of 12,000 was prepared.

[Preparation of Dispersion (2)]

| | |
|---|---|
| Styrene: | 280 g |
| n-butylacrylate: | 120 g |
| acrylic acid: | 8 g |

These materials were mixed and dissolved and were then added to a flask of 550 g of ion-exchanged water in which 6 g of nonionic surfactant (Nonipol 400 available from Sanyo Chemical Industries, Ltd.) and 12 g of anionic surfactant (Neogen SC available from Dai-ichi Kogyo Seiyaku Co., Ltd.) were dissolved. In the flask, the mixture was then dispersed, emulsified, and slowly mixed for 10 minutes while adding 50 g of ion-exchanged water in which 3 g of ammonium persulfate is dissolved. Nitrogen substitution is conducted, and the flask is heated in an oil bath with stirring until the mixture (content) is 70° C., and it was kept for 5 hours so that emulsion polymerization was allowed to continue. As a result, a dispersion (2) containing resin particulates having an average diameter of 105 nm, glass transition temperature of 53° C., and weight average molecular weight (Mw) of 550,000 was prepared.

[Preparation of Colorant Dispersion (1)]

| | |
|---|---|
| Carbon black: (available from Cabot Corporation: Mogul L) | 50 g |
| Nonionic surfactant: (available from Sanyo Chemical Industries, Ltd.: Nonipol 400) | 5 g |
| Ion-exchanged water: | 200 g |

There materials were mixed and dissolved. The mixture was then dispersed for 10 minutes using a homogenizer (available from IKA: Ultra Turrax T50). Thus, a colorant dispersion (1) containing colorant (carbon black) having an average particle diameter of 250 nm dispersed therein was prepared.

[Preparation of Release Agent Dispersion (1)]

| | |
|---|---|
| Paraffin wax: (available from Nippon Seiro Co., Ltd.; HNP0190, melting point 85° C.) | 50 g |
| Cationic surfactant: (available from Kao Corporation: Sanisol B50) | 7 g |
| Ion-exchanged water: | 200 g |

These materials were heated to 95° C., dispersed using a homogenizer (available from IKA: Ultra Turrax T50), and thereafter dispersed using a high-pressure homogenizer. Thus, a release agent dispersion (1) containing release agent having an average particle diameter of 550 nm dispersed therein was prepared.

[Preparation of Aggregated Particles]

| | |
|---|---|
| Dispersion (1): | 120 g |
| Dispersion (2): | 80 g |
| Colorant dispersion (1): | 30 g |
| Release agent dispersion (1): | 40 g |
| Cationic surfactant: | 1.5 g |

(available from Kao Corporation: Sanisol B50)

These materials were mixed in a round stainless flask and dispersed using a homogenizer (available from IKA: Ultra Turrax T50). Then, the flask was put in a heating oil bath and heated with stirring to 48° C. The flask was kept at 48° C. for 30 minutes and thereafter the mixture was observed with an optical microscope. It was observed that aggregated particles having an average diameter of about 5 μm were formed (volume: 95 cm3).

<Second Step>

[Preparation of Adhesive Particles]

To this mixture, 60 g of dispersion (1) were slowly added as a resin-containing particulate dispersion. The volume of resin particulates contained in the dispersion (1) was 25 cm3. Then, the temperature of the heating oil bath was raised to 50° C. and kept for 1 hour.

<Third Step>

After that, 3 g of anionic surfactant (available from Dai-ichi Kogyo Seiyaku Co., Ltd.: Neogen SC) were added to the mixture and then the stainless flask was sealed. While using a magnetic seal, the mixture was continuously stirred, heated to 105° C., and kept for 3 hours. Thereafter, it was cooled and then reacted products were filtered, well washed with ion-exchanged water, and dried to obtain a toner base particle. Then, 100 parts of the toner base particles, 1 part of hydrophobic silica and 1 part of hydrophobicized titanium oxide were mixed using a Henschel mixer to provide a toner.

Like Example 1, a cross section of the thus obtained toner particle was prepared and observed. No pores were observed.

The properties of the toner are shown in Table 1, and evaluation results thereof are shown in Table 2.

Comparative Example 3

In a reaction vessel equipped with a condenser, a stirrer, and a nitrogen inlet tube, 724 parts of bisphenol A ethylene oxide dimolar adduct, 276 parts of isophthalic acid, and 2 parts of dibutyl tin oxide were placed, and the reaction was performed under a normal pressure at 230° C. for 8 hours, and under a reduced pressure of 10 mmHg to 15 mmHg for 5 hours, then it was cooled to 160° C. and 32 parts of anhydrous phthalic acid was introduced into the reaction vessel, after which the reaction was carried out for 2 hours. Next, the mixture was cooled to 80° C. and reacted with 188 parts of isophorone diisocyanate in ethyl acetate for 2 hours to give isocyanate group-containing prepolymer (1). Then, 267 parts of the prepolymer (1) and 14 parts of isophorone diamine were reacted at 50° C. for 2 hours to obtain an urea-modified polyester having a weight average molecular weight of 64,000. In the same manner as above, 724 parts of bisphenol A ethylene oxide dimolar adduct, 138 parts of terephthalic acid, and 138 parts of isophthalic acid were polymerized under a normal pressure at 230° C. for 6 hours, and under a reduced pressure of 10 mmHg to 15 mmHg for 5 hours, to obtain an unmodified polyester (a) having a peak molecular weight of 2,300, hydroxyl value of 55, and acid value of 1. In 1000 parts of ethyl acetate/MEK (ratio: 1/1) mixture solvent, 200 parts of urea-modified polyester (1) and 800 parts of unmodified polyester (a) were dissolved and mixed to obtain an ethyl acetate/MEK solution of toner binder (1). To a reaction vessel having a condenser, stirrer, and thermometer, 942 parts of water, 58 parts of 10% suspension of hydroxyapatite (Supatite 10 available from Nippon Chemical Industrial Co., Ltd.) were put and then stirred while 1000 parts of the ethyl acetate/MEK solution of toner binder (1) was added and dispersed. The temperature was raised to 98° C. to remove organic solvents and thereafter the dispersion was cooled. Next, it was filtered with water, washed, and dried. Thus, a toner binder (1) was obtained. For the toner binder (1), Tg was 52° C., Tη was 123°, and TG' was 132° C.

By the following method, 100 parts of the toner binder (1), 7 parts of glycerin tribehenate, and 4 parts of cyanine blue KRO (available from Sanyo Color Works, Ltd.) were made into a toner.

First, a Henschel mixer (FM10B available from Mitsui Mining) is used for preliminary mixing, and then the mixture was kneaded with a double-axis kneader (PCM-30 available from Ikegai Ltd.). Then, a supersonic jet pulverizer Labo Jet (Nippon Pneumatic Mfg. Co., Ltd.) is used to pulverize and thereafter an air flow classifier (MDS-I available from Nippon Pneumatic Mfg. Co., Ltd.) is used to classify and obtain toner base particles. Then, 100 parts of the toner base particles, 1 part of hydrophobic silica and 1 part of hydrophobicized titanium oxide were mixed using a Henschel mixer to provide a toner.

Like Example 5, a cross section of the thus obtained toner particle was prepared and observed. No pores were observed.

The properties of the toner are shown in Table 1, and evaluation results thereof are shown in Table 2.

Comparative Example 4

(Manufacture Example of Prepolymer)

In a reaction vessel equipped with a condenser, a stirrer, and a nitrogen inlet tube, 724 parts of bisphenol A ethylene oxide dimolar adduct, 276 parts of isophthalic acid, and 2 parts of dibutyl tin oxide were placed, and the reaction was performed under a normal pressure at 230° C. for 8 hours, and then it was reacted while being dehydrated under a reduced pressure of 10 mmHg to 15 mmHg for 5 hours, then it was cooled to 160° C. and 74 parts of anhydrous phthalic acid was introduced into the reaction vessel, after which the reaction was carried out for 2 hours. Next, the mixture was cooled to 80° C. and reacted with 174 parts of ethylene glycol diglycidylether in toluene for 2 hours to give epoxy group-containing prepolymer (1) having weight average molecular weight of 13,000.

(Manufacture Example of Ketimine Compound)

Into a reaction vessel equipped with a stirrer and a thermometer, 30 parts of isohorone diamine and 70 parts of methyl ethyl ketone were introduced, and the reaction was performed at 50° C. for 5 hours to obtain ketimine compound (2).

(Manufacture Example of Dead Polymer)

In the same manner as above, 654 parts of bisphenol A ethylene oxide dimolar adduct and 516 parts of dimethyl ester terephthalate were polymerized under a normal pressure at 230° C. for 6 hours, and then it was reacted while being dehydrated for 5 hours under a reduced pressure of 10 mmHg to 15 mmHg, to obtain a dead polymer (1) having a peak molecular weight of 2,400 and hydroxyl value of 2.

(Manufacture Example of Toner)

In a beaker, 15.4 parts of the prepolymer (1) and 64 parts of the dead polymer (1) were stirred and dissolved in 78.6 parts of ethyl acetate. Next, 20 parts of pentaerythritol tetrabehenate and 4 parts of cyanine blue KRO (available from Sanyo Color Works) were added to the mixture, and the mixture was stirred at 60° C. using a TK homomixer at 12,000 rpm so that the mixture is uniformly dissolved and dispersed. Finally, 2.7 parts of ketimine compound (2) was added and dissolved. Thus, a toner material solution (1) is obtained. Into a beaker, 706 parts of ion-exchanged water, 294 parts of 10% suspension of hydroxyapatite (Supatite 10 available from Nippon Chemical Industrial Co., Ltd.) and 0.2 parts of sodium dodecylbenzene sulfonate were added and uniformly dissolved. Then, the temperature of the mixture was raised to 60° C. and the mixture was stirred using a TK homomixer at 12,000 rpm while the toner material solution (1) was added and kept stirred for 10 minutes. Thereafter, the mixture was transferred to a flask having a stirrer and thermometer, and heated to 98° C. Solvent was removed while the mixture was ureated, and then it was filtered, washed, dried, and thereafter classified by air flow to obtain toner base particles. Then, 100 parts of the toner base particles, 1 part of hydrophobic silica and 1 part of hydrophobicized titanium oxide were mixed using a Henschel mixer to provide a toner. The toner binder component had a weight average molecular weight of 14,000, number average molecular weight of 2,000, and glass transition point (Tg) of 52° C.

Like Example 5, a cross section of the thus obtained toner particle was prepared and observed. No pores were observed.

The properties of the toner are shown in Table 1, and evaluation results thereof are shown in Table 2.

Comparative Example 5

Method of Producing A-polymer 300 g of methanol, 100 g of toluene, 570 g of styrene, 30 g of 2-acrylamide-2-methyl propane sulfonic acid, 12 g of laurylperoxide are introduced in two flasks provided with a stirrer, a condenser, a thermometer, a nitrogen inlet gas and are stirred, the solution is polymerized at 65° C. for 10 hours with the nitrogen introduced. Then, the content was taken out of the flasks, dried under reduced pressure, pulverized with a jet mill, to thereby produce A-polymer (Mw=3000).

Preparation of Toner

| | |
|---|---|
| Styrene | 183 parts |
| 2-ethyl hexyl acrylate | 17 parts |
| A-polymer | 0.1 part |
| C. I. Pigment Yellow 17 | 7 parts |
| Paraffin wax {melting point 155° F. (Taisei)} | 32 parts |
| Initiator {V-601 (available from Wako)} | 10 parts |

The above preparation was heated at 65° C., evenly dissolved and dispersed, to thereby obtain a monomer composition.

Otherwise, a silane coupling agent [KBE903 (available from Shin-Etsu silicones)] was evenly dispersed in 1200 ml of ion-exchanged water, then 6 g of colloidal silica [Aerosil

#200 (available from Nippon Aerosil Co., Ltd.)] was inputted to be evenly dispersed further. The thus obtained dispersion was adjusted to have pH=6, to thereby prepare a dispersion medium system.

The above monomer composition was inputted into the dispersion medium system, and the mixture was stirred at 6,500 rpm for 60 minutes with a TK homomixer at 70° C. under nitrogen atmosphere, to thereby form particles of the monomer composition. Then, it was polymerized at 75° C. for 8 hours while being stirred with a paddle.

After the polymerization, the reacted product was cooled, and 20% by weight NaOH aqueous solution was added thereto for alkaline treatment for one night. Then, the dispersant was dissolved, filtered, washed by water, dried, to thereby obtain the polymerized toner.

Like Example 9, a cross section of the thus obtained toner particle was prepared and observed. No pores were observed.

The properties of the toner are shown in Table 1, and evaluation results thereof are shown in Table 2.

Comparative Example 6

A toner is obtained in the same manner as that in Example 1 except that the preparation of oil phase, the processes of emulsification and solvent removal were changed to have conditions as described below.

(Preparation of Oil Phase)

Into a vessel equipped with a stirrer and a thermometer, 378 parts of "low molecular weight polyester 1," 100 parts of carnauba wax, and 947 parts of ethyl acetate were introduced, and the temperature was raised to 80° C. with stirring, maintained at 80° C. for 5 hours, and cooled to 30° C. in 1 hour. Next, 900 parts of "masterbatch 1" and 500 parts of ethyl acetate were introduced into the vessel, and mixed for 1 hour to obtain "initial material solution 7." To a vessel, 1324 parts of "initial material solution 7" were transferred, and carbon black and wax were dispersed using a bead mill (ultra bead mill available from Imex) under the conditions of liquid feed rate of 1 kg/hr, disk circumferential speed of 6 m/sec, 0.5 mm zirconia beads packed to 80 volume % and 3 passes. Next, 1324 parts of a 65% ethyl acetate solution of "low molecular weight polyester 1" was added and dispersed in 2 passes by the bead mill under the aforesaid conditions to obtain "pigment/wax dispersion 7." The solid concentration of "pigment/wax dispersion 7" (130° C., 30 minutes) was 50%.

Emulsification and Solvent Removal

In a vessel, 749 parts of "pigment/wax dispersion 7," 115 parts of "prepolymer 1" and 2.9 parts of "ketimine compound 1" were placed and mixed at 5,000 rpm for 0.5 minute by a TK homomixer (available from Tokushu Kika Kogyo Co., Ltd.), then 1700 parts of "aqueous phase 1" were added to the vessel and mixed by the TK homomixer at a rotation speed of 14,000 rpm for 10 minutes to obtain "emulsion slurry 12."

"Emulsion slurry 12" was placed in a vessel equipped with a stirrer and a thermometer, then the solvent was removed at 30° C. for 8 hours and the product was matured at 65° C. for 3 hours to obtain "dispersion slurry 12."

Figure 9:
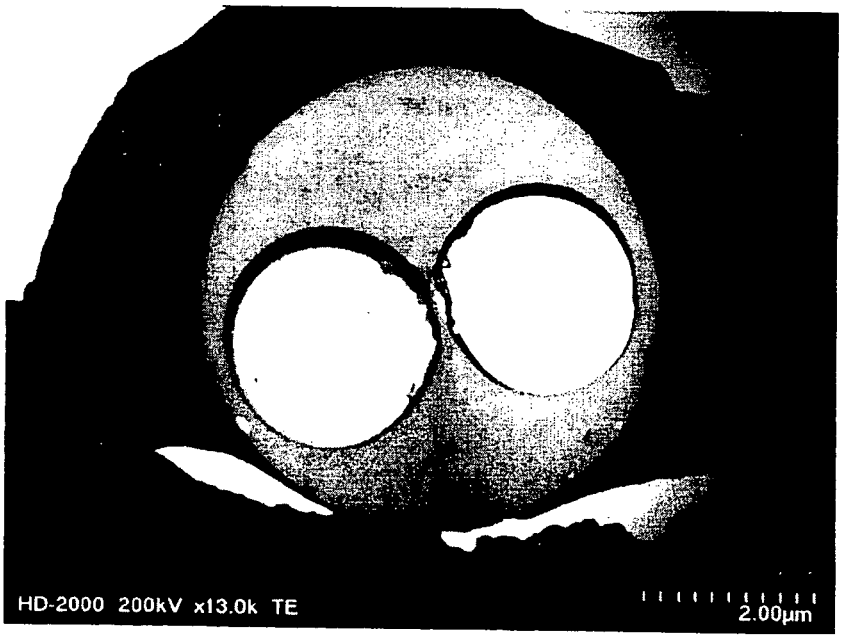
FIG. 9 is an STEM image of a cross section of toner particle obtained by a Comparative example 6.

Like Example 9, a cross section of the thus obtained toner particle was prepared and observed. FIG. 9 shows an SEM image.

The properties of the thus obtained toner are shown in Table 1, and evaluation results thereof are shown in Table 2.

(Evaluation of Two-component Developers)

Evaluations for two-component developers were conducted in the following manner. Using ferrite carriers with an average diameter of 35 μm on which a silicone resin is coated by an average thickness of 0.5 μm, 100 parts by weight of the carriers were uniformly mixed with 7 parts by weight of toner of each color in a TURBULAR MIXER (available from SHINMARU ENTERPRISES CORPORATION) in which a container rotates to mix the materials so as to charge the mixture and thus a developer was prepared.

[Process for Manufacturing Carriers]

| | |
|---|---|
| *Core material | |
| Mn ferrite particles (weight average diameter: 35 μm): | 5,000 parts |
| *Coating materials | |
| Toluene: | 450 parts |
| Silicone resin SR 2400: (available from Dow Corning Toray Silicone Co., Ltd., non-volatile portion 50%) | 450 parts |
| Aminosilane SH 6020: (available from Dow Corning Toray Silicone Co., Ltd.) | 10 parts |
| Carbon black: | 10 parts |

The above described coating materials were dispersed for 10 minutes using a stirrer to prepare a coating dispersion. The coating dispersion and the core material were poured in a coating apparatus that had a rotating base plate disk and stirring blades in a fluidized bed, so as to form a whirling flow and conduct coating. Thus, the coating dispersion was applied onto the core material. The coated material was then baked in an electric oven at 250° C. for 2 hours and thus the carriers were made.

(Evaluations)

1) Image Density

An imagio Neo 450 (Ricoh Company, Ltd.) is modified into a belt fusing system. Using the modified copier, solid images with adhering toner amount of 0.3±0.1 mg/cm2 were printed on sheets of plain paper (Type 6200 available from Ricoh). Then, the image density of the sheets were measured with an X-Rite (available from X-Rite), and evaluated as Good when the image density is 1.4 or more and Poor if it is less than 1.4.

2) Fusibility (Hot Offset Resistance and Low Temperature Fusibility)

An imagio Neo 450 (Ricoh Company, Ltd.) is modified into a belt fusing system. Using the modified copier, solid images with adhering toner amount of 1.0±0.1 mg/cm2 were printed on sheets of plain paper and thick paper (Type 6200 available from Ricoh, and copy and print paper <135> available from NBS Ricoh Company, Ltd.). Fusing tests were conducted with different fusing temperatures at the fusing belt, and the highest temperature at which no hot offset occurred on plain paper sheets was determined as upper limit fusing temperature. Also, the lower limit fusing temperature was measured using thick paper sheets. The lower limit fusing temperature is determined as the temperature of a fusing roller at which a fused image is rubbed with a pad and the remaining rate of the image density of the fused image is 70% or more. It is preferred that the upper limit fusing temperature is 200° C. or more and the lower limit fusing temperature is 140° C. or less.

3) Cleanability

After an output of 1000 sheets with chart images of 95% toner coverage and a subsequent cleaning process, the toner remaining on a photoconductor after transfer is conveyed to a sheet of white paper using Scotch tape (available from Sumitomo 3M, Co., Ltd.). The sheet is then measured with a Macbeth reflection densitometer RD 514 and the difference between a sample and a blank is evaluated. The sample is rated as Very Good when the difference is less than 0.005, Good when the difference is from 0.005 to 0.010, Fair when the difference is from 0.011 to 0.02, and Poor when the difference is more than 0.02.

4) Transferability

After chart images of 20% toner coverage are transferred from a photoconductor to paper, the toner remaining on a photoconductor on the eve of the cleaning is conveyed to a sheet of white paper using Scotch tape (available from Sumitomo 3M, Co., Ltd.). The sheet is then measured with a Macbeth reflection densitometer RD 514 and the difference between a sample and a blank is evaluated. The sample is rated as Very Good when the difference is less than 0.005, Good when the difference is from 0.005 to 0.010, Fair when the difference is from 0.011 to 0.02, and Poor when the difference is more than 0.02.

5) Charge Stability

An IPSiO Color 8100 (available from Ricoh Company, Ltd.) is modified and tuned into an oil-less fusing system. Using the modified evaluation copier, the difference of charge amount for each toner was measured by conducting an endurance test of 100,000-sheet successive output with chart images of 5% toner coverage. The charge amount difference is obtained from 1 g of developer with a blow off method. Each toner was evaluated as Very Good when the difference is 4 μc/g or less, Good when the difference is 5 μc/g or less, Fair when the difference is 10 μc/g or less, and Poor when the difference is more than 10 μc/g.

6) Image Graininess and Sharpness

An IPSiO Color 8100 (available from Ricoh Company, Ltd.) is modified and tuned into an oil-less fusing system. Using the modified evaluation copier, photographic images were output in monochrome and the levels of graininess and sharpness were evaluated with naked eyes as Very Good, Good, Fair, and Poor, in this order, from better to worse. Very Good indicates the image is comparative to offset prints, Good indicates that it is slightly inferior to offset prints, Fair indicates the image is considerably inferior to offset prints, and Poor indicates the image is as good as conventional electrophotographic images and is very bad.

7) Fog

An IPSiO Color 8100 (available from Ricoh Company, Ltd.) is modified and tuned into an oil-less fusing system. Using the modified evaluation copier at temperature of 10° C. and humidity of 15%, an endurance test of 100,000-sheet successive output with chart images of 5% toner coverage was conducted. Then, toner contamination of the background portion of a printed sheets is evaluated with eyes using a magnifier as Very Good, Good, Fair, and Poor, in this order, from better to worse. Very Good indicates the toner contamination is not observed at all and is in a good condition, Good indicates that very little contamination is observed and is not so much of a problem, Fair indicates that some contamination is observed, and Poor indicates that the contamination is out of allowance, very dirty, and is problematic.

8) Toner Scatter

An IPSiO Color 8100 (available from Ricoh Company, Ltd.) is modified and tuned into an oil-less fusing system. Using the modified evaluation copier at temperature of 40° C. and humidity of 90%, an endurance test of 100,000-sheet successive output with chart images of 5% toner coverage was conducted. Then, toner contamination inside the copier is evaluated with naked eyes. Very Good indicates the toner contamination is not observed at all and is in a good condition, Good indicates that very little contamination is observed and is not so much of a problem, Fair indicates that some contamination is observed, and Poor indicates that the contamination is out of allowance, very dirty, and is problematic.

9) Environmental Preservability (Anti-blocking)

A sample of each toner was taken in an amount of 10 g and put in a 20 ml glass container. After the glass container was tapped 100 times, it was set in a thermostat at a temperature of 55° C. and humidity of 80% for 24 hours. Then, penetration is measured using a penetrometer. In addition, penetration of toner samples that were kept in a cold and dry environment (10° C., 15%) was also measured, and the lower value of penetration of the following two conditions, hot and humid and cold and dry, was used for evaluation. The samples were evaluated as Very Good when the penetration was 20 mm or more, Good when it was 15 mm or more and less than 20 mm, Fair when it was 10 mm or more and less than 15 mm, and Poor when it was less than 10 mm.

TABLE 1

| | Toner's properties | | | | | | |
|---|---|---|---|---|---|---|---|
| | | | | | Particle diameter | | |
| | Porosity | Average sphericity | Sphericity factor SF-1 | Sphericity factor SF-2 | Volume average particle diameter (Dv) | Number average particle diameter (Dn) | Dv/Dn |
| Example 1 | 0.28 | 0.97 | 130 | 121 | 5.1 | 4.5 | 1.13 |
| Example 2 | 0.23 | 0.94 | 128 | 130 | 6.5 | 4.8 | 1.35 |
| Example 3 | 0.59 | 0.98 | 140 | 128 | 3.1 | 2.6 | 1.19 |
| Example 4 | 0.02 | 0.93 | 134 | 139 | 7.9 | 6.7 | 1.18 |
| Example 5 | 0.04 | 0.97 | 128 | 140 | 5.5 | 4.5 | 1.22 |
| Example 6 | 0.42 | 0.96 | 124 | 141 | 6.3 | 5.9 | 1.07 |
| Example 7 | 0.33 | 0.98 | 118 | 142 | 4.5 | 3.6 | 1.25 |
| Example 8 | 0.18 | 0.92 | 151 | 153 | 6.7 | 5.4 | 1.24 |
| Example 9 | 0.03 | 0.93 | 138 | 139 | 8.2 | 6.8 | 1.21 |
| Example 10 | 0.34 | 0.94 | 128 | 134 | 7.8 | 5.5 | 1.42 |
| Comparative example 1 | Pore not found | 0.97 | 119 | 120 | 5.0 | 4.4 | 1.14 |
| Comparative example 2 | Pore not found | 0.91 | 140 | 160 | 6.6 | 5.6 | 1.18 |
| Comparative example 3 | Pore not found | 0.88 | 160 | 155 | 7.0 | 5.4 | 1.30 |
| Comparative example 4 | Pore not found | 0.94 | 138 | 138 | 3.3 | 2.8 | 1.18 |
| Comparative example 5 | Pore not found | 0.96 | 125 | 123 | 7.1 | 5.8 | 1.22 |
| Comparative example 6 | 0.62 | 0.98 | 116 | 122 | 4.4 | 3.8 | 1.16 |

TABLE 2

| | Evaluation results | | | | | | | | | |
|---|---|---|---|---|---|---|---|---|---|---|
| | | Fusible temperature | | | | | | | | |
| | Image density | Lower limit (° C.) | Upper limit (° C.) | C | T | CS | IGS | Fog | Toner scatter | EP |
| Example 1 | Good | 140 | 210 or more | Good | Good | Good | Good | Good | Good | Good |
| Example 2 | Good | 135 | 180 | Good | Good | Very good | Good | Very good | Good | Very good |
| Example 3 | Good | 130 | 210 or more | Fair | Fair | Fair | Very good | Fair | Fair | Good |
| Example 4 | Good | 140 | 210 or more | Good | Very good | Good | Fair | Very good | Very good | Very good |
| Example 5 | Good | 130 | 190 | Very good | Good | Good | Fair | Good | Very good | Good |
| Example 6 | Good | 130 | 150 | Fair | Very good | Very good | Good | Good | Good | Very good |
| Example 7 | Good | 140 | 210 or more | Good | Good | Fair | Fair | Very good | Good | Fair |
| Example 8 | Good | 140 | 210 or more | Very good | Fair | Good | Fair | Good | Fair | Good |
| Example 9 | Good | 155 | 195 | Fair | Very good | Good | Fair | Good | Good | Good |
| Example 10 | Good | 155 | 195 | Fair | Fair | Good | Fair | Fair | Fair | Fair |
| Comparative example 1 | Poor | 130 | 140 | Poor | Poor | Good | Good | Fair | Poor | Poor |
| Comparative example 2 | Poor | 150 | 185 | Good | Good | Poor | Fair | Poor | Poor | Poor |
| Comparative example 3 | Poor | 145 | 150 | Very good | Good | Fair | Poor | Fair | Poor | Fair |
| Comparative example 4 | Poor | 145 | 150 | Good | Fair | Poor | Fair | Poor | Poor | Poor |
| Comparative example 5 | Poor | 145 | 150 | Fair | Fair | Poor | Fair | Poor | Poor | Poor |
| Comparative example 6 | Good | 140 | 210 or more | Poor | Poor | Poor | Poor | Poor | Poor | Poor |

C: Cleanability
T: Transferability
CS: Charge Stability
IGS: Image Graininess and Sharpness
EP: Environmental Preservability Under the present invention, the following paragraph (1) to paragraph (6) can be provided:

(1) A toner, an image forming apparatus and a process for forming an image that reduce the amount of toner's adhesion to paper and the like per unit area while securing developability, transferability, and fusibility, and that obtain image quality with sufficient image density.

(2) An image forming apparatus and a process for forming an image that secure sufficiently high charge performance of toner, bring about good charge rising property of toner, cause a small amount of toner spent to carrier and the like even when tens of thousands of images are outputted, maintain high chargeability and flowability, reduce background shading (fog), and bring about an image with sufficient density.

(3) A toner, a developer, an image forming apparatus, and a process for forming an image whose cleanability is maintained, that comply with low temperature fusing system, whose offset resistance is favorable, and that do not contaminate a fusing apparatus and an image.

(4) An image forming apparatus and a process for forming an image that form images with little background shading (fog) having excellent charge stability in hot and humid or cold and dry environment, and in which toner's spreading out inside a machine is small in quantity.

(5) An image forming apparatus and a process for forming an image that are both highly durable and highly maintainable as an image forming system.

(6) A process for measuring a porosity of a toner.

What is claimed is:

1. A toner for developing an electrostatic image, comprising:

a colorant; and a binder resin, wherein the toner includes a particle comprising at least one pore having a diameter of 10 nm or over, and a porosity thereof is in a range from 0.01 to 0.60, and the particle of the toner has an average sphericity E of 0.90 to 0.99, where E is calculated by dividing the perimeter of a circle having a same projected area as the toner particle with the perimeter of the toner particle.

2. A toner for developing an electrostatic image according to claim 1, wherein the diameter of the at least one pore included in the particle of the toner is 50 nm or over.

3. A toner for developing an electrostatic image according to claim 1, wherein the diameter of the at least one pore included in the particle of the toner is 200 nm or over.

4. A toner for developing an electrostatic image according to claim 1, wherein the particle of the toner comprises ten or more pores, the diameter of each of the pores being 10 nm or over.

5. A toner for developing an electrostatic image according to claim 1, wherein the porosity is in a range from 0.01 to 0.50.

6. A toner for developing an electrostatic image according to claim 1, wherein the toner is constituted of a particle which is formed by a manufacturing process comprising:

dispersing in a water medium an oil droplet of an organic solvent in which the toner's composition comprising a prepolymer is contained, and at least one of elongating and cross-linking of the prepolymer.

7. A toner for developing an electrostatic image according to claim 6, wherein the manufacturing process further comprises a degassing reaction.

8. A toner for developing an electrostatic image according to claim 6, wherein the prepolymer comprises an isocyanate-group, and an amine is used as at least one of an elongation agent and a cross-linking agent when the prepolymer is subjected to the at least one of the elongation process and the cross-linking process.

9. A toner for developing an electrostatic image according to claim 1, wherein the toner comprises at least a polyester resin.

10. A toner for developing an electrostatic image according to claim 9, wherein the toner comprises at least a modified polyester resin.

11. A toner for developing an electrostatic image according to claim 10, wherein the toner further comprises an unmodified polyester resin.

12. A toner for developing an electrostatic image according to claim 1, wherein the particle of the toner has a sphericity SF-1 of 100 to 150 and a sphericity SF-2 of 100 to 140, where $$SF\text{-}1=(L^2/A)\times(\pi/4)\times 100,$$

$$SF\text{-}2=(P^2/A)\times(1/4\pi)\times 100, \text{ when}$$

L=an absolute maximum length of a toner particle,

A=a projected area of a toner particle, and

P=a maximum perimeter of a toner particle.

13. A toner for developing an electrostatic image according to claim 1, wherein the particle of the toner has a volume average particle diameter Dv of 2 μm to 7 μm and Dv/Dn of 1.25 or below which is a ratio of the volume average particle diameter Dv to a number average particle diameter Dn.

14. A toner for developing an electrostatic image according to claim 13, wherein the volume average particle diameter Dv of the particle of the toner is 4 μm to 7 μm.

15. A two-component developer, comprising:

a carrier made of a magnetic particle; and a toner for developing an electrostatic image, the toner comprising:

a colorant, and a binder resin, wherein the toner includes a particle comprising at least one pore having a diameter of 10 nm or over, and a porosity thereof is in a range from 0.01 to 0.60, and the particle of the toner has an average sphericity E of 0.90 to 0.99, where E is calculated by dividing the perimeter of a circle having a same projected area as the toner particle with the perimeter of the toner particle.

16. An image forming apparatus, comprising:

an electrostatic image carrier;

a charging unit for charging the electrostatic image carrier;

an exposing unit for making an exposure, in a form of an image, to the electrostatic image carrier charged by the charging unit to thereby form an electrostatic image;

a developing unit packed with a developer, and developing with the developer the electrostatic image on the electrostatic image carrier to thereby form a toner image; and a transfer unit abutting on a surface of the electrostatic image carrier via a transfer material, and transferring the toner image to the transfer material, wherein the developer is a two-component developer comprising:

a carrier made of a magnetic particle, and a toner for developing the electrostatic image, the toner comprising:

a colorant, and a binder resin, wherein the toner includes a particle comprising at least one pore having a diameter of 10 nm or over, and a porosity thereof is in a range from 0.01 to 0.60, and the particle of the toner has an average sphericity E of 0.90 to 0.99, where E is calculated by dividing the perimeter of a circle having a same projected area as the toner particle with the perimeter of the toner particle.

17. A process for forming an image, comprising:

charging an electrostatic image carrier;

exposing, in a form of an image, to the electrostatic image carrier charged by the charging to thereby form an electrostatic image;

developing with a developer the electrostatic image on the electrostatic image carrier to thereby form a toner image; and transferring the toner image to a transfer material by allowing a transfer unit to abut on a surface of the electrostatic image carrier via the transfer material and, wherein the developer comprises:

a colorant, and a binder resin, wherein a toner includes a particle comprising at least one pore having a diameter of 10 nm or over, and a porosity thereof is in a range from 0.01 to 0.60, and the particle of the toner has an average sphericity E of 0.90 to 0.99, where E is calculated by dividing the perimeter of a circle having a same projected area as the toner particle with the perimeter of the toner particle.

18. A process cartridge, comprising:

an electrostatic image carrier; and at least one of the following:

a developing unit packed with a developer, and developing with the developer an electrostatic image on the electrostatic image carrier to thereby form a toner image, a charging unit for charging the electrostatic image carrier, and a cleaning unit for removing a toner remaining after a transfer on a surface of the electrostatic image carrier, so as to form an integrated structure, wherein the process cartridge is adapted to be attached to and detached from a main body of an image forming apparatus, wherein the developer comprises:

a colorant, and a binder resin, wherein the toner includes a particle comprising at least one pore having a diameter of 10 nm or over, and a porosity thereof is in a range from 0.01 to 0.60, and the particle of the toner has an average sphericity E of 0.90 to 0.99, where E is calculated by dividing the perimeter of a circle having a same projected area as the toner particle with the perimeter of the toner particle.

* * * * *